United States Patent [19]

Rizzoli

[11] Patent Number: 4,595,236

[45] Date of Patent: Jun. 17, 1986

[54] ARTICULATED CHAIR WITH WEIGHT RESPONSIVE RESILIENT MEANS

[75] Inventor: Ennio Rizzoli, S. Lazzaro di Savena, Italy

[73] Assignee: Castelli S.p.A., Bologna, Italy

[21] Appl. No.: 630,130

[22] Filed: Jul. 12, 1984

[30] Foreign Application Priority Data

Jul. 12, 1983 [IT] Italy ..... 67756 A/83
May 17, 1984 [IT] Italy ..... 67495 A/84

[51] Int. Cl.[4] ..... A47C 1/032

[52] U.S. Cl. ..... 297/316; 297/304; 297/321; 297/338

[58] Field of Search ..... 297/300, 301, 304, 316, 297/320, 321, 338, 340

[56] References Cited

U.S. PATENT DOCUMENTS 4,471,994 9/1984 Zund et al. ..... 297/316
4,479,679 10/1984 Fries et al. ..... 297/304 X

FOREIGN PATENT DOCUMENTS 3200360 12/1982 Fed. Rep. of Germany ..... 297/340

*Primary Examiner*—William E. Lyddane
*Assistant Examiner*—Peter R. Brown
*Attorney, Agent, or Firm*—Sughrue, Mion, Zinn, Macpeak & Seas

[57] ABSTRACT

A chair is described which comprises a fixed base structure, a seat, an element moveable relative to the fixed structure of the chair, the moveable element being moveable from a first operative position to a second operative position as a result of a thrust exerted by the body of a seated person, and resilient means biasing the moveable element towards its first operative position. The seat of the chair has at least one part moveable substantially vertically (the movement of the moveable element being distinct from the substantially vertical movement of the moveable part of the seat). The chair also includes a resilient member for returning the moveable part of the seat to a raised position for sensing the weight of the seated person, and for adjusting automatically the load of the resilient member in dependence on the weight of the seated person.

18 Claims, 32 Drawing Figures

Figure 1:
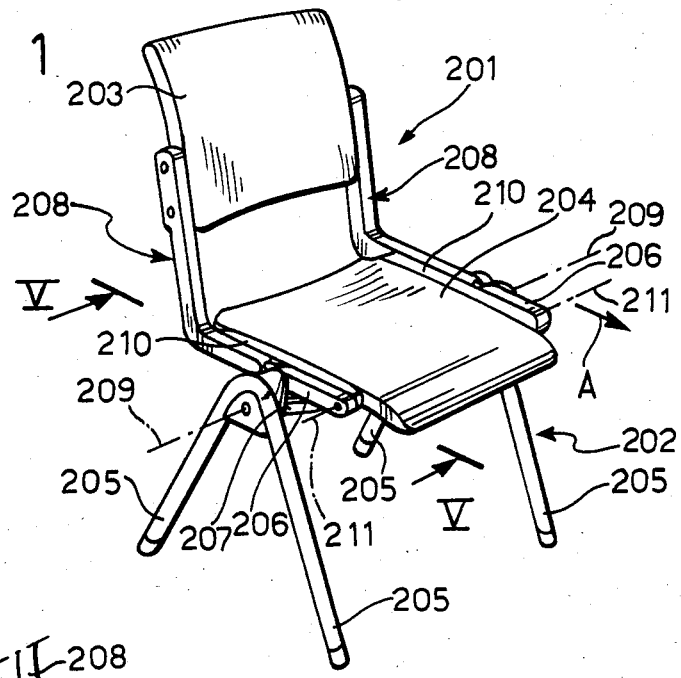

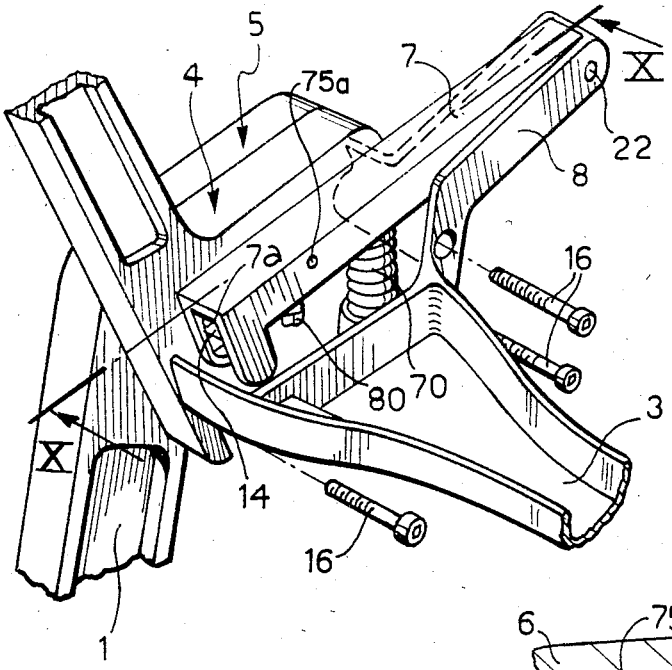
FIG. 9
FIG. 11
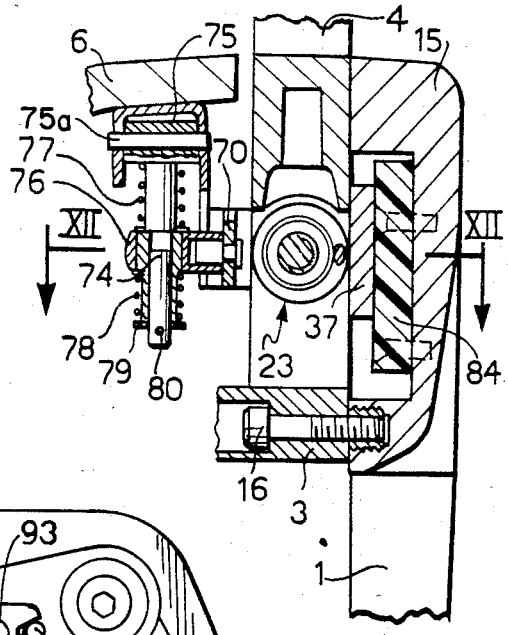
FIG. 13
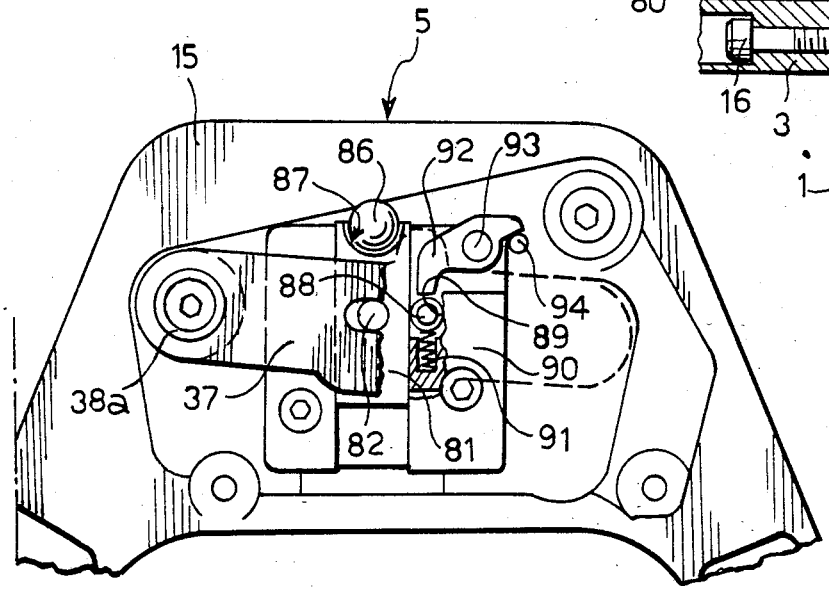

ARTICULATED CHAIR WITH WEIGHT RESPONSIVE RESILIENT MEANS

The present invention relates to chairs of the type comprising:

a fixed base structure, a seat, an element movable relative to the fixed structure of the seat, the movable element being movable from a first operative position to a second operative position by a thrust exerted by the body of a seated person, and resilient means biassing the movable element towards the first operative position.

There have been known and used for some time chairs of the aforesaid type in which, for example, the said movable element is constituted by a backrest support structure articulated to the fixed structure about a horizontal transverse axis whereby the first operative position corresponds to a substantially erect condition of the backrest and the said second operative position corresponds to a partially-reclined condition of the backrest. In such known seats, the load of the said resilient biassing means is always the same, which results in different levels of comfort for persons of different weights. Chairs have also been made which are provided with a manually controlled device for adjusting the load of the resilient biassing means but this solution is not entirely satisfactory, particularly in the case of chairs for public use (for example, chairs for congress halls, theatres, etc.) where it is unthinkable for each new user to adjust the chair in dependence on his own specific requirements.

The object of the present invention is to provide a chair of the type specified at the beginning of the present specification, which enables identical levels of comfort to be achieved for persons of different weights.

In order to achieve this object, the invention provides a chair comprising:

a fixed base structure, a seat, an element movable relative to the fixed structure of the chair, the movable element being movable from a first operative position to a second operative position by a thrust exerted by the body of a seated person, and resilient means biassing the movable element towards the first operative position, characterised in that the seat of the chair has at least one part movable substantially vertically, the movement of the movable element being separate from the substantially vertical movement of the movable seat part, and in that the chair further includes:

resilient means for returning the movable part of the seat to a raised position and for acting as means for sensing the weight of the seated person, and means for automatically adjusting the load of the resilient biassing means in dependence on the weight detected by the sensor means.

The invention can be applied, for example, to chairs in which the said movable element is constituted by a backrest support structure articulated to the said structure to allow the backrest to recline rearwardly, or, according to a further example, to chairs in which the movable element is constituted by the seat itself, which is pivotally mounted about a transverse horizontal axis which in its turn is movable vertically relative to the fixed structure. It is necessary to note that in the present description and in the following claims, however, the movable element is intended to be any element which can fulfil a movement distinct from the substantially vertical movement of the said movable seat part.

The present invention can be applied, in particular, to a chair in which the movable element is constituted by a backrest support for the backrest which is articulated to the fixed structure about a first transverse horizontal axis, in which the seat is also articulated to the fixed structure of the chair about a second transverse horizontal axis located forwardly of the said first transverse horizontal axis, and in which the seat is operatively connected to the backrest support structure so that a pivoting movement of the backrest about the first axis causes pivoting of the seat about the second axis.

A chair of this type is described and illustrated in Italian Patent Application No. 67755-A83 by the same Applicant and in the corresponding European Patent Application.

When the invention is applied to a chair of this type, it must be remembered that, when a person sits on the seat, the resilient return means of the seat are loaded and the latter disposes itself in a vertical position which is a function of the weight of the seated person; the load of the resilient biassing means of the backrest are thus automatically adjusted in dependence on the weight detected. However, when the person rests against the backrest and inclines it rearwardly, this movement of the backrest also causes a further downward movement of the seat with a consequent further loading of the resilient return means for the seat. There is thus the problem of preventing this further loading of the resilient return means for the seat from altering the load condition of the resilient biassing means of the backrest previously calibrated in dependence on the weight of the seated person.

In a preferred embodiment of the invention, this problem is solved by the fact that the resilient biassing means comprise at least one resilient cartridge having a first end connected to the support structure of the backrest at a point spaced from the articulation axis of the backrest support structure to the fixed structure of the chair whereby the first end of the resilient cartridge effects a circular path about the articulation axis when the backrest is reclined, and a second end supported by the fixed structure by means of a lever articulated to the fixed structure about an axis parallel to and spaced from the articulation axis of the backrest support structure, this second end being connected operatively to the seat, and in that the automatic adjusting means include means for locking the second end of the resilient cartridge in the position taken up as a result of the lowering of the seat caused by the weight of the seated person when the backrest is reclined.

In a further embodiment, this problem is solved by the fact that the automatic adjusting means include actuator means for connecting the seat operatively to the backrest only when the seated person starts to exert a thrust against the backrest, and for allowing the movement of the seat independently of the backrest as long as the seated person does not exert this thrust against the backrest, the resilient return means for the seat being shaped and disposed so as also to act as resilient biassing means for the backrest.

Figure 2:
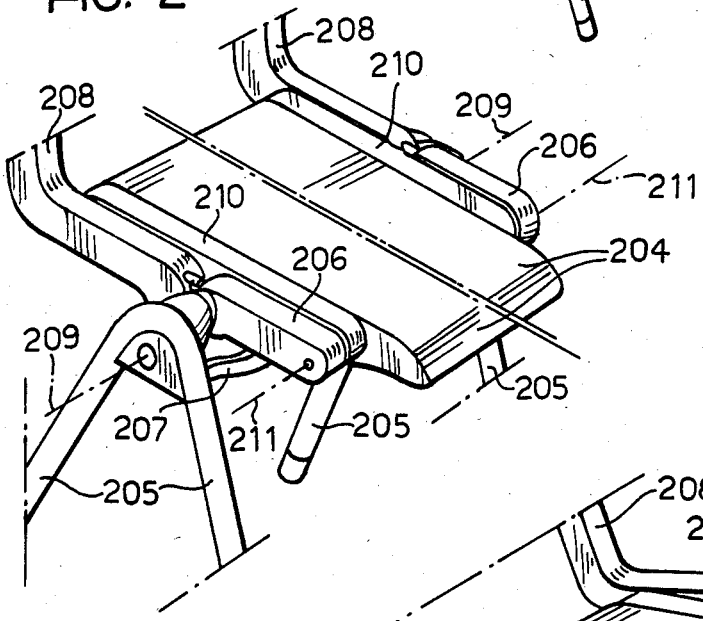
Figure 3:
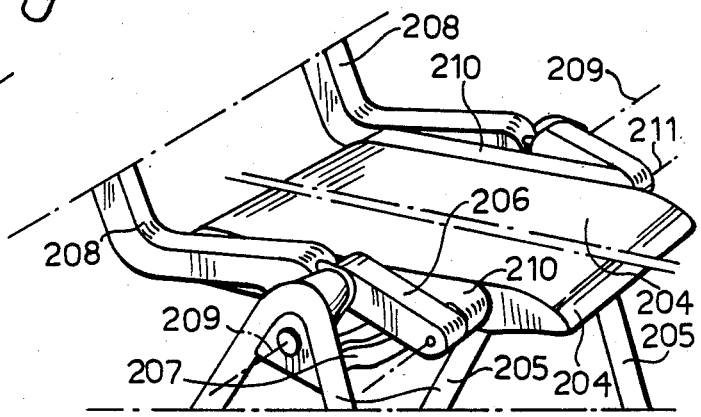
Figure 4:
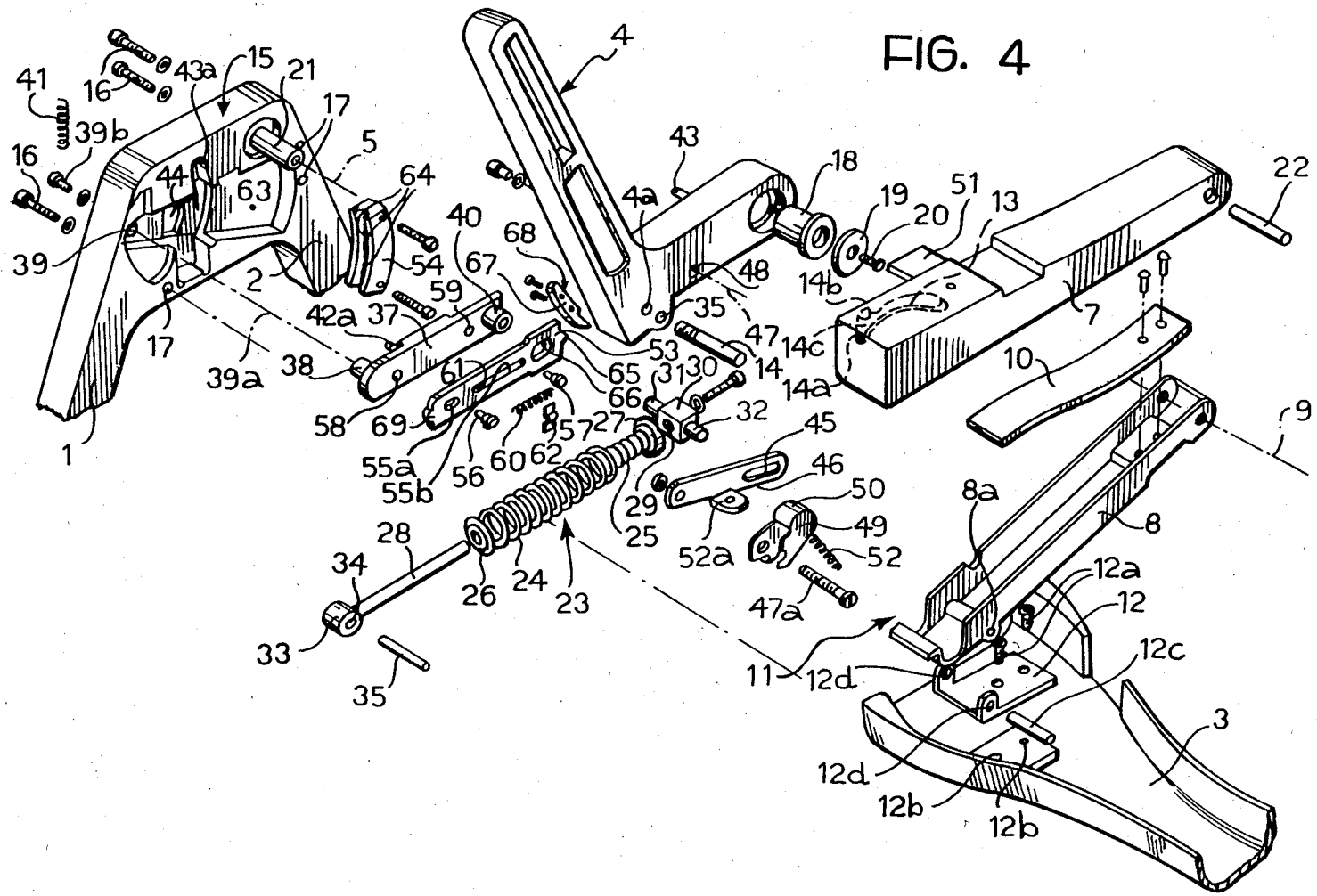
Figures 5, 8:
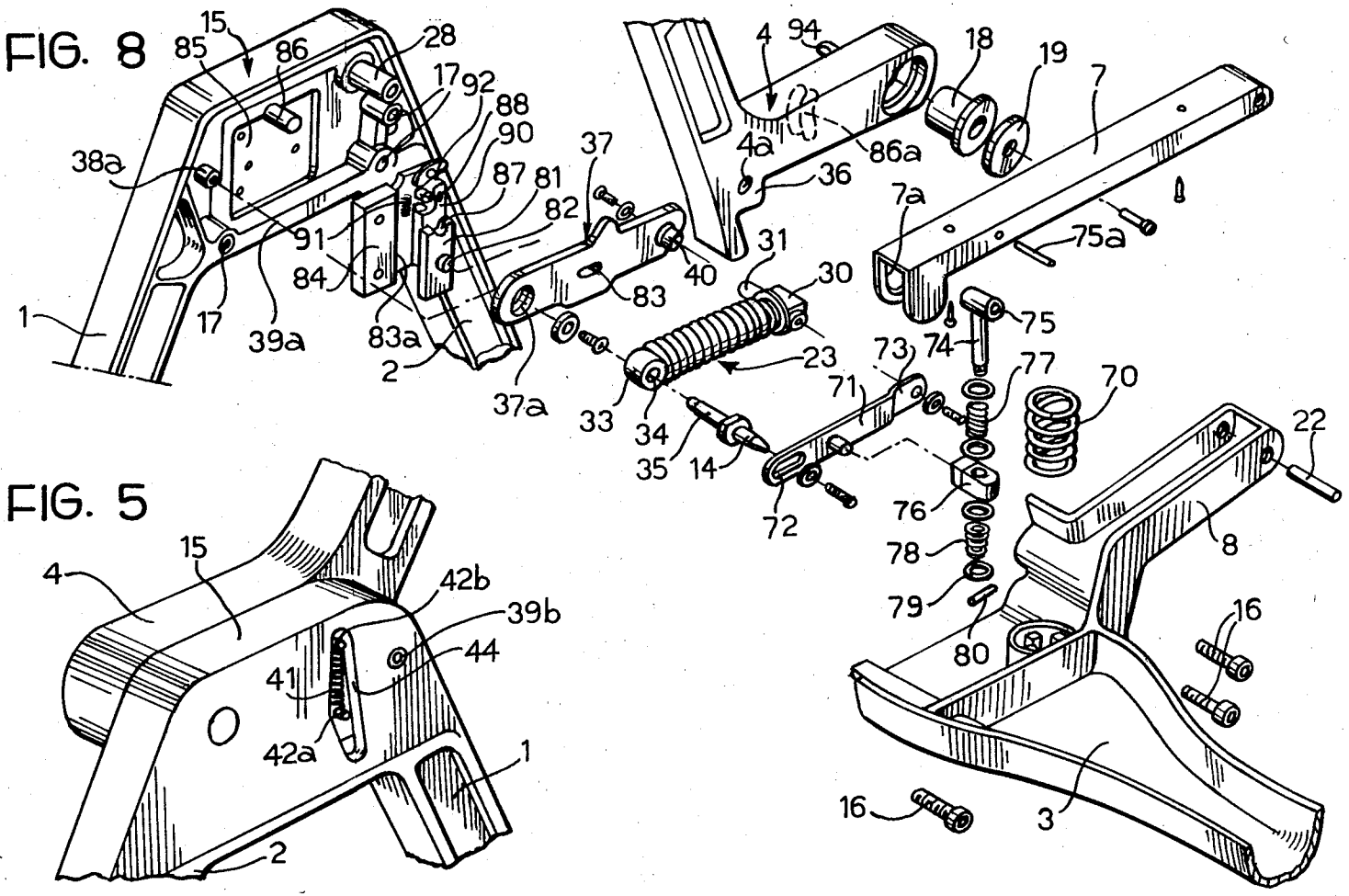
Figure 6:
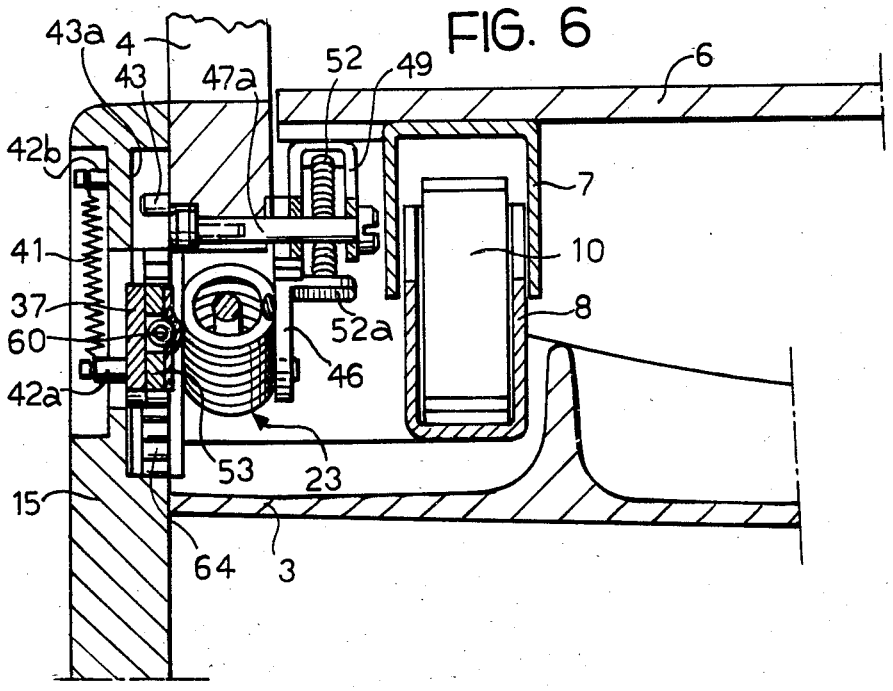
Figure 7:
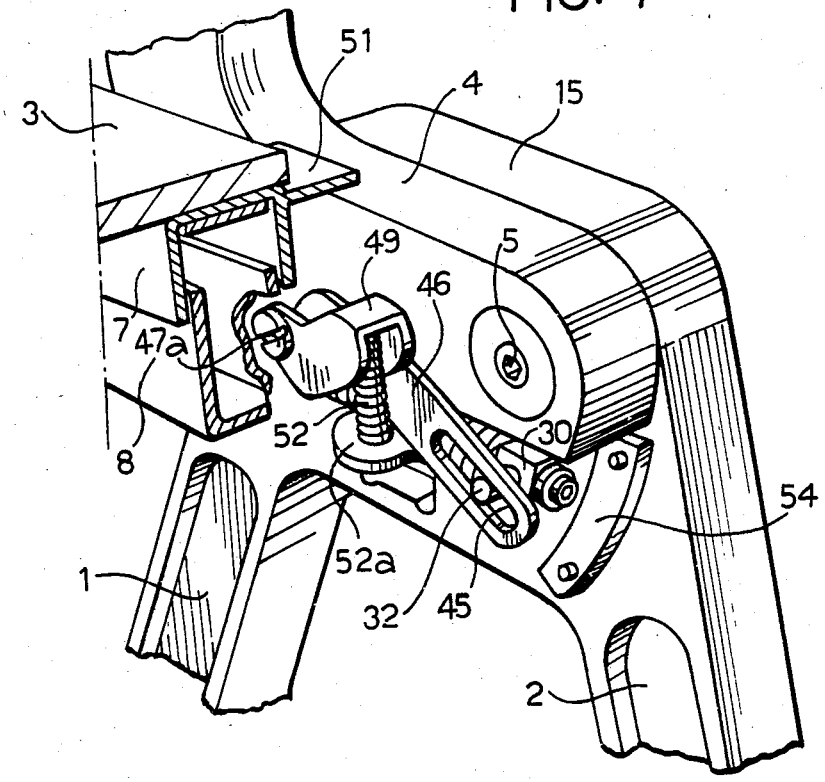
Figure 10:
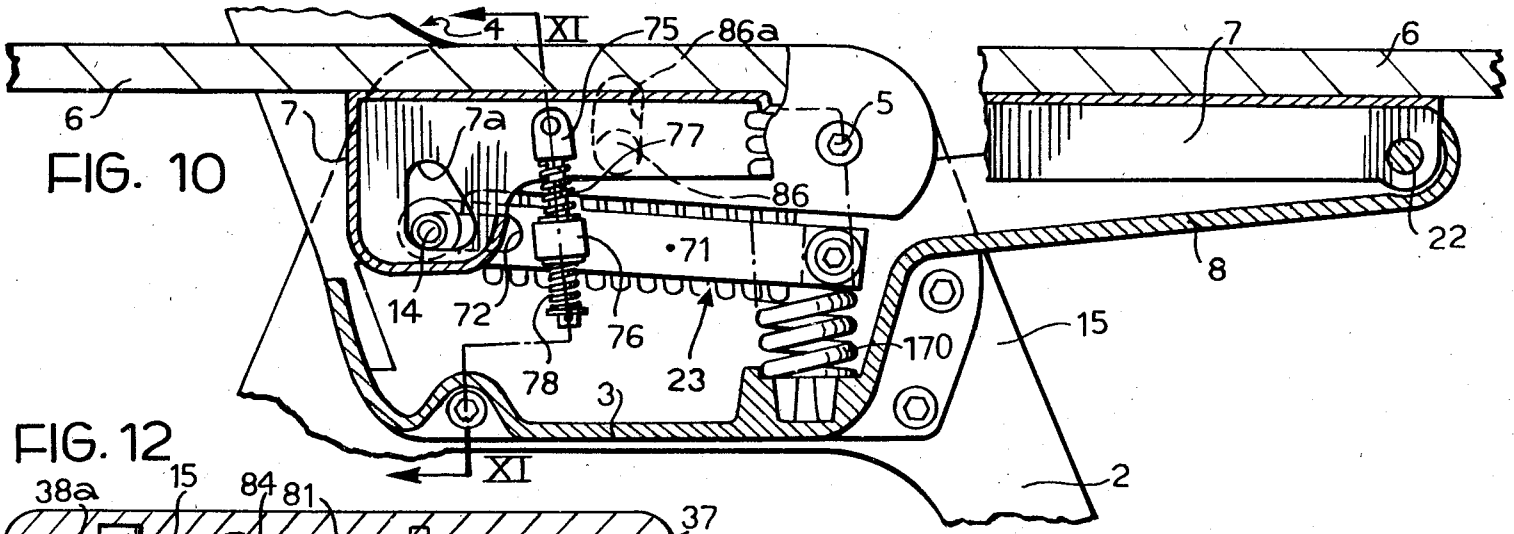
Figure 12:
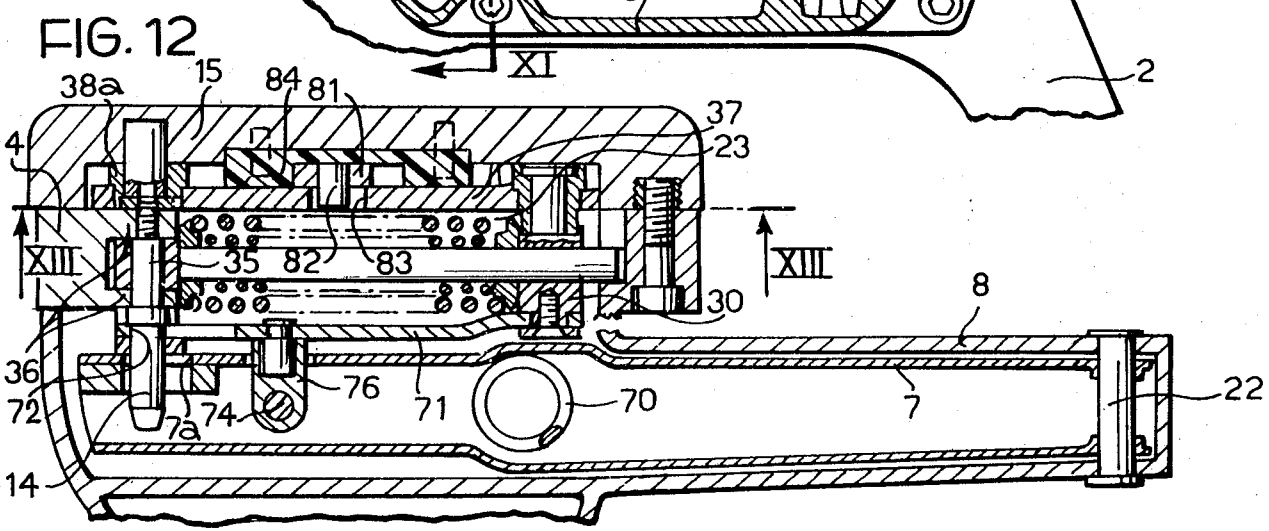
Figure 14:
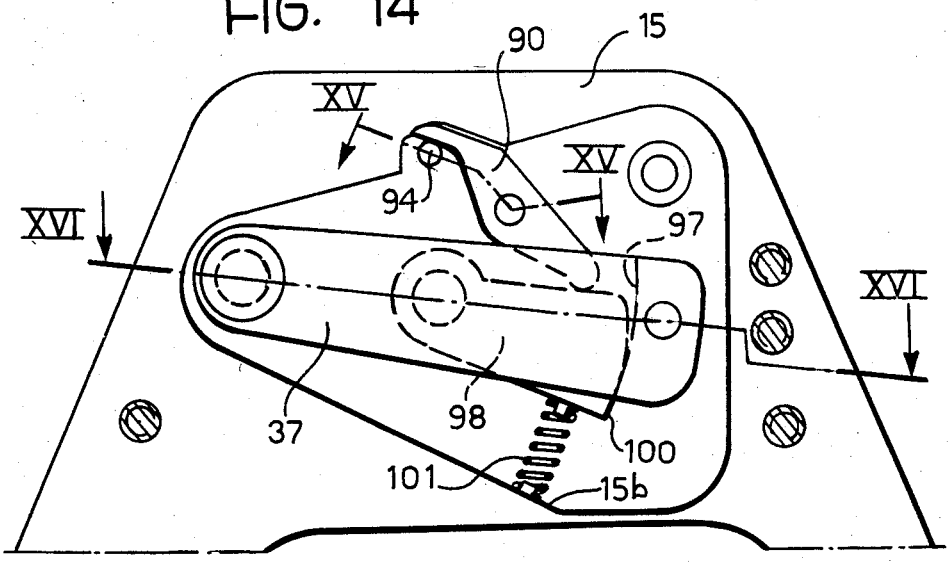
Figure 15:
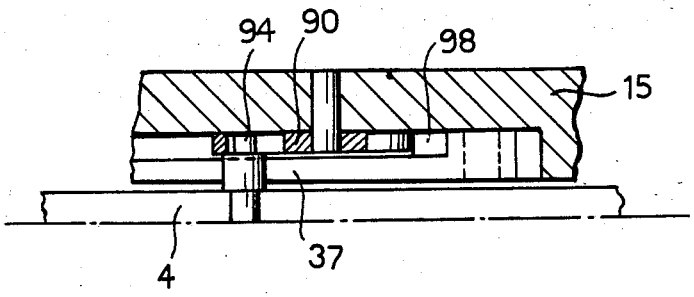
Figure 16:
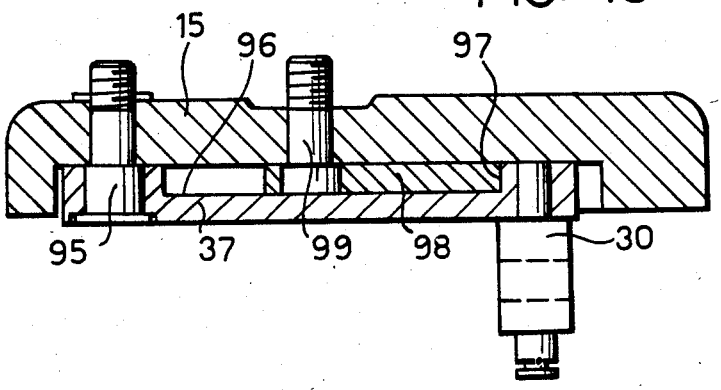
Figure 17:
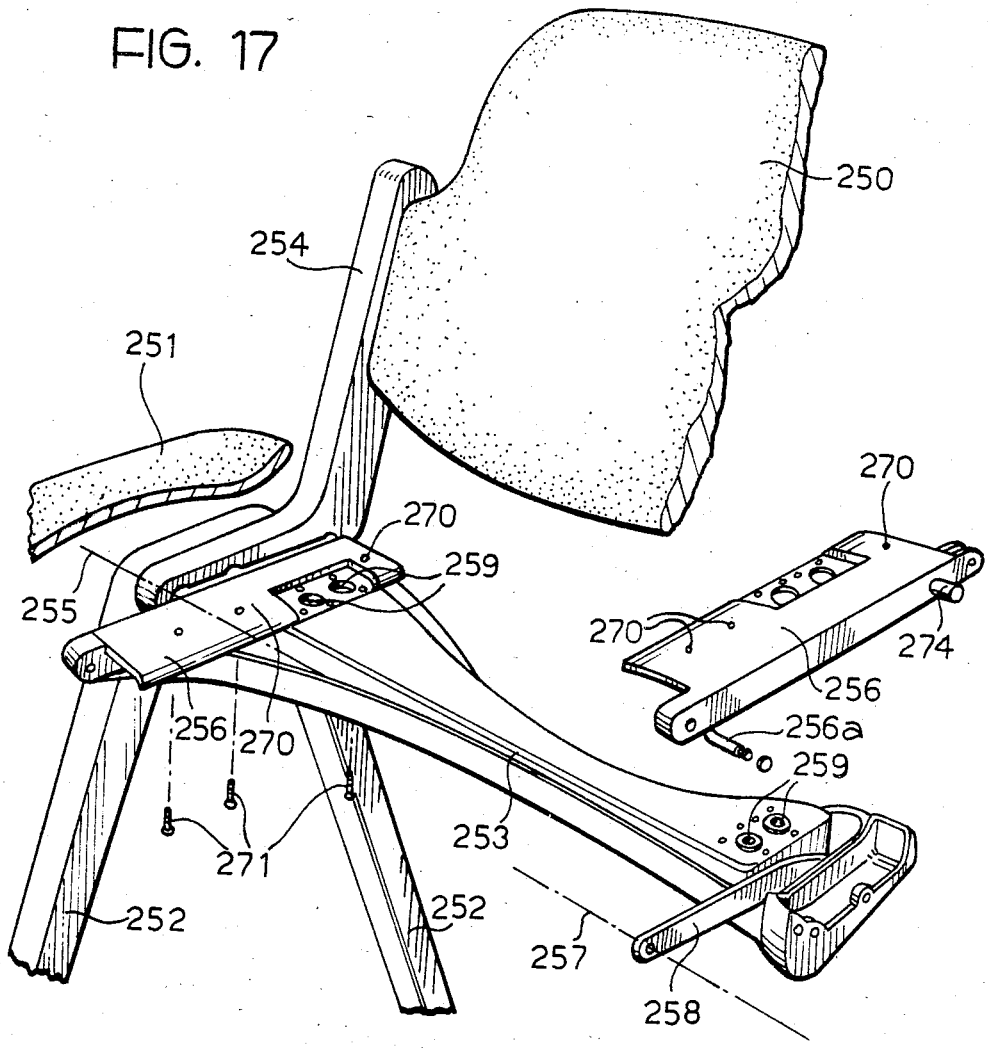
Figure 23:
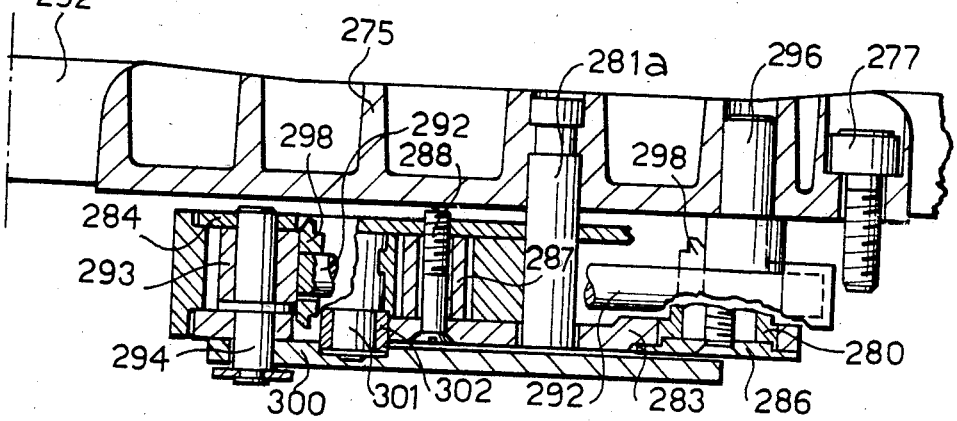
Figure 18:
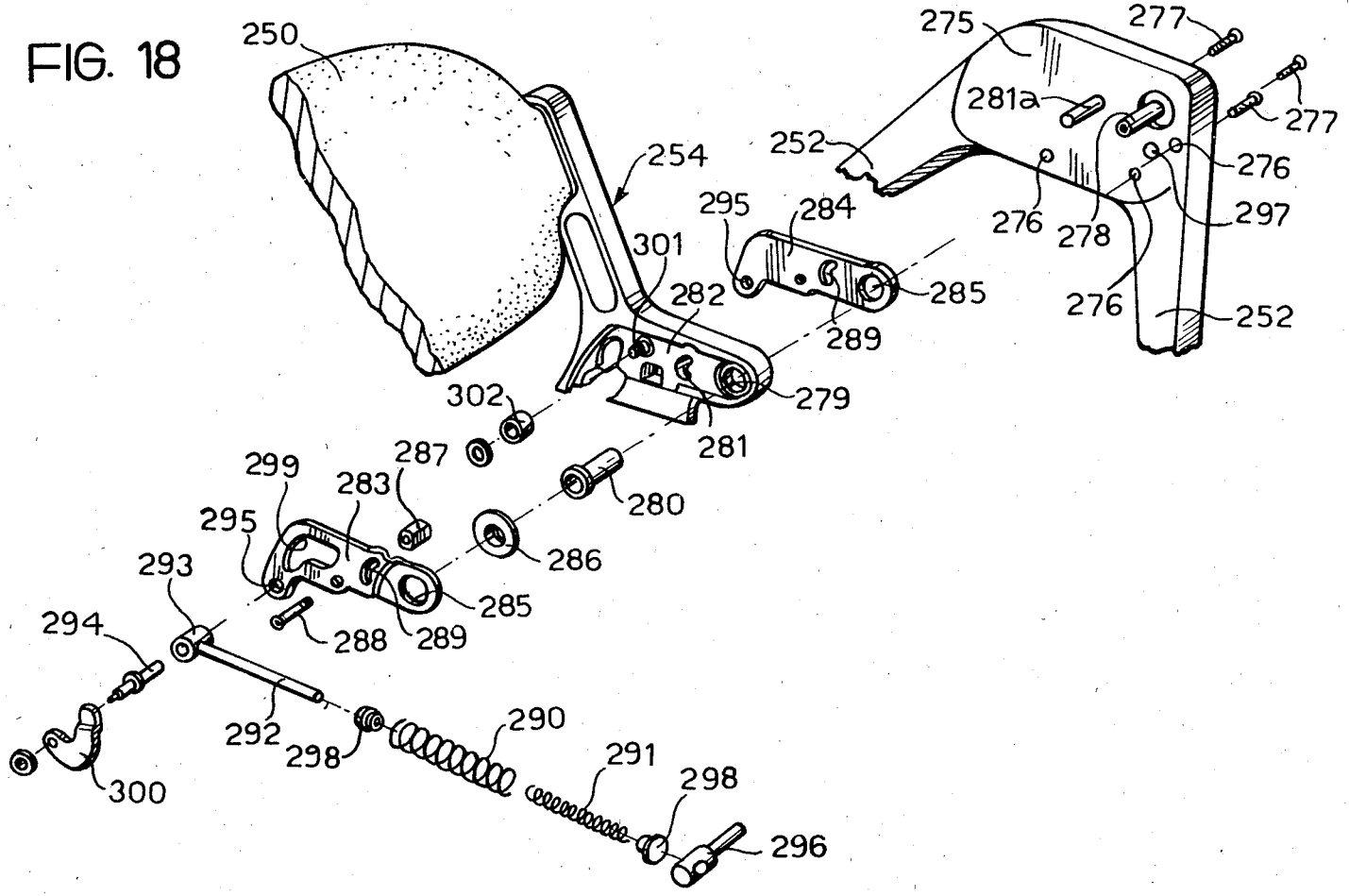
Figure 19:
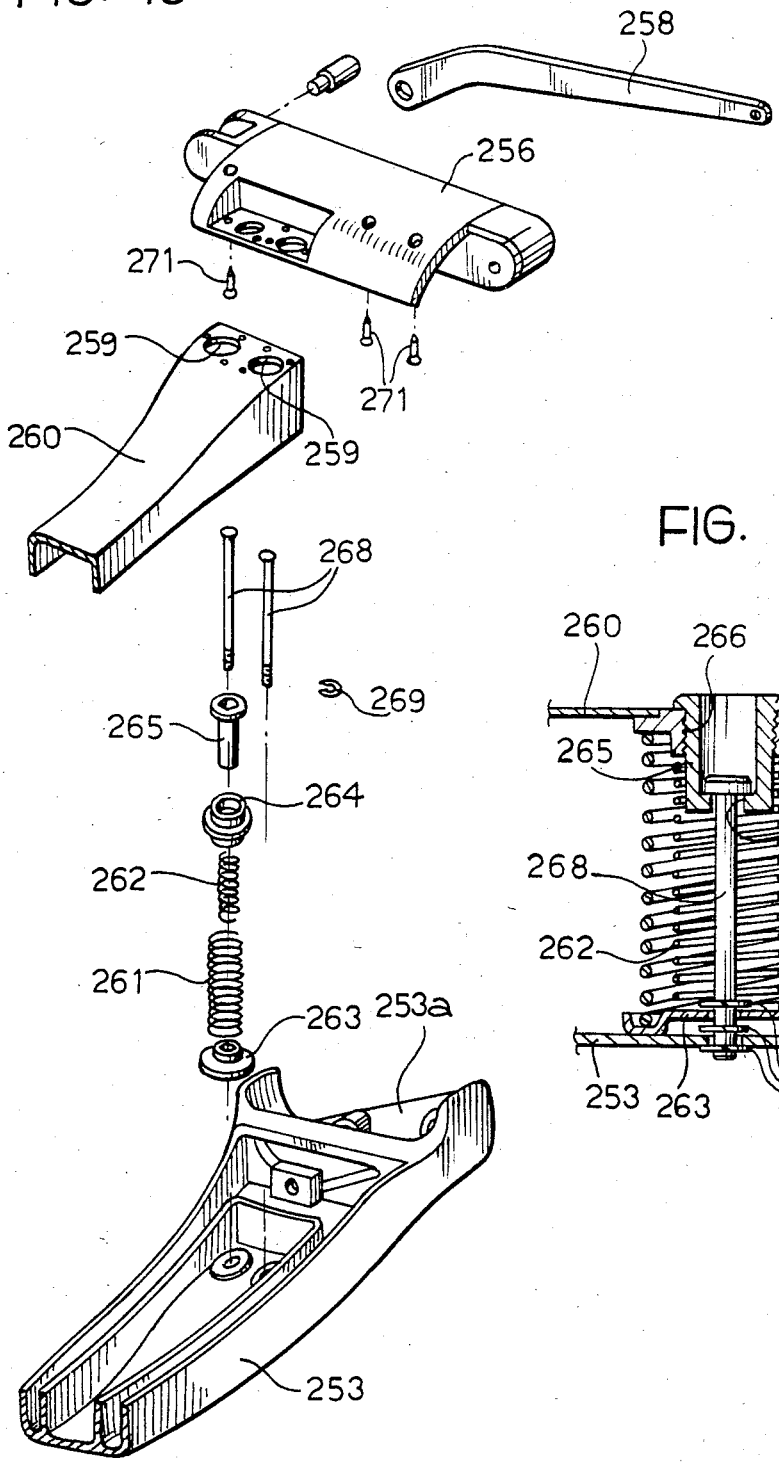
Figure 24:
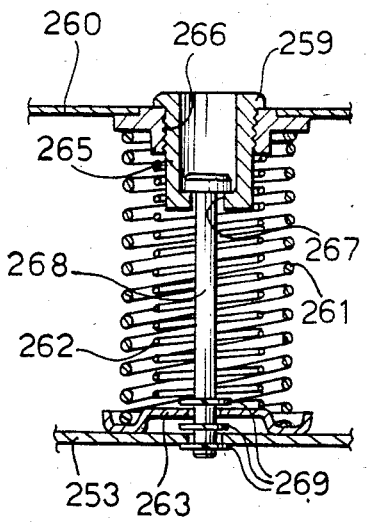
Figure 20:
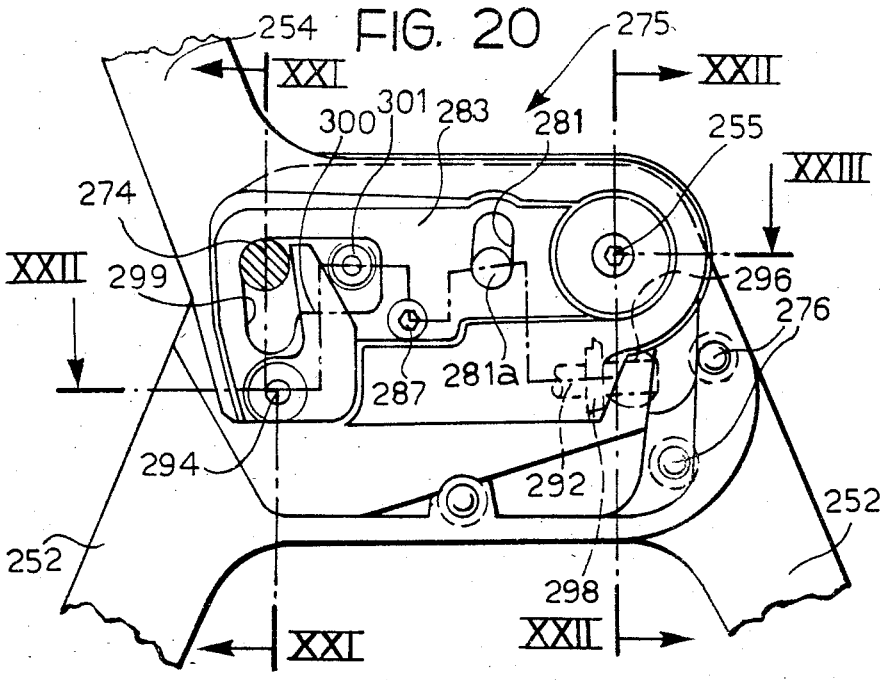
Figure 21:
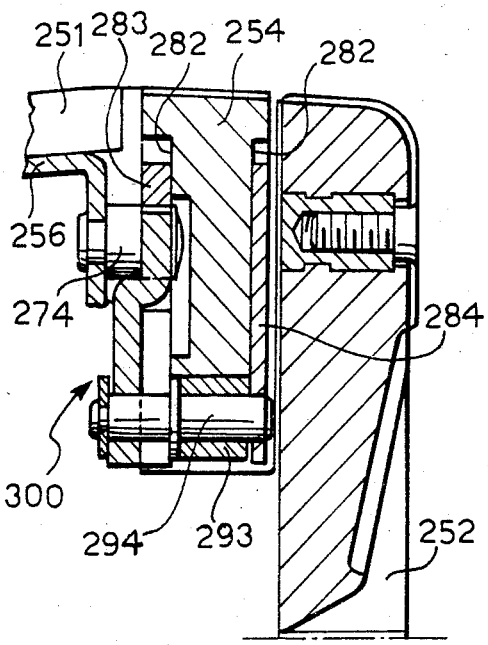
Figure 22:
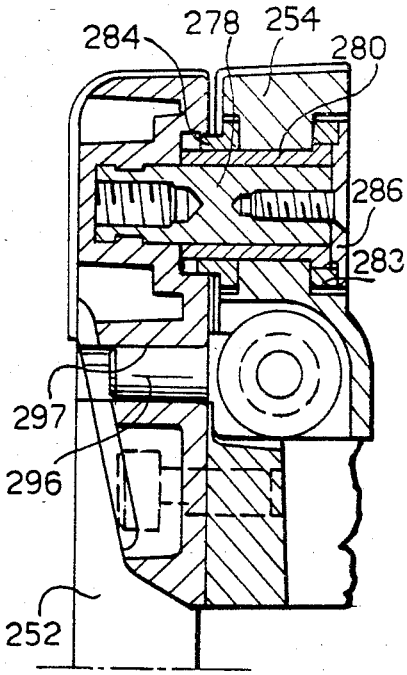
Figure 25:
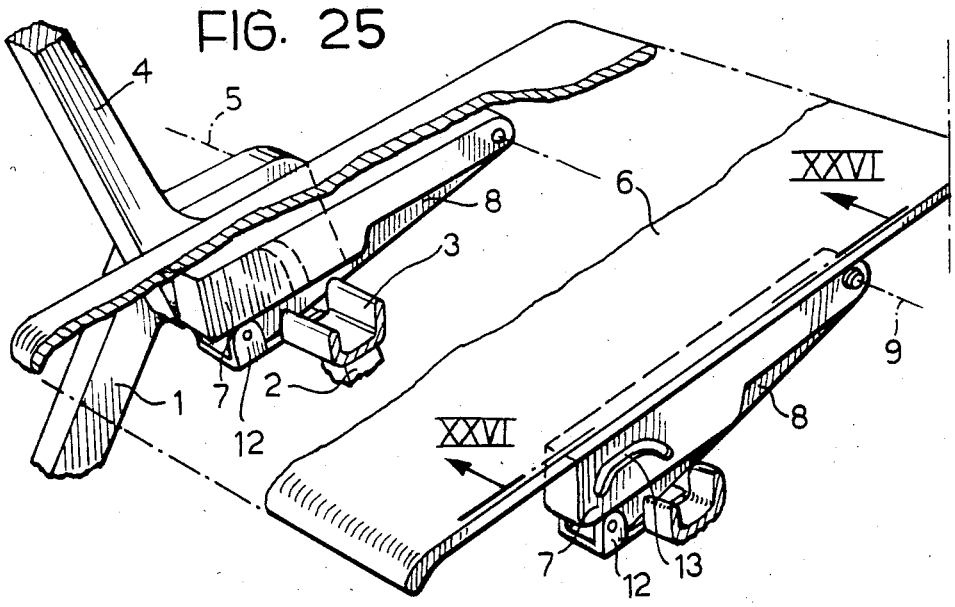
Figure 26:
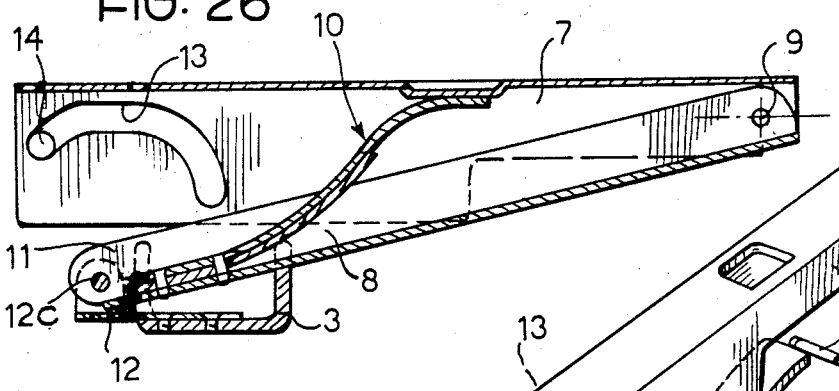
Figure 27:
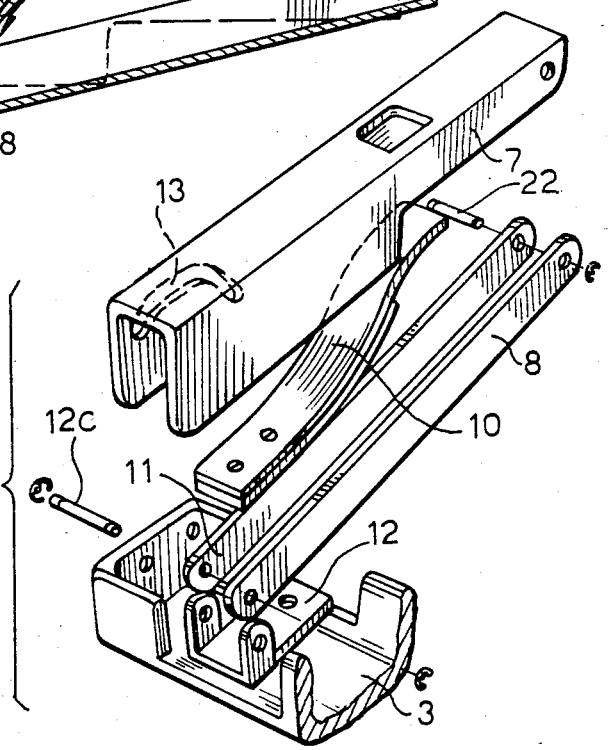
Figure 29:
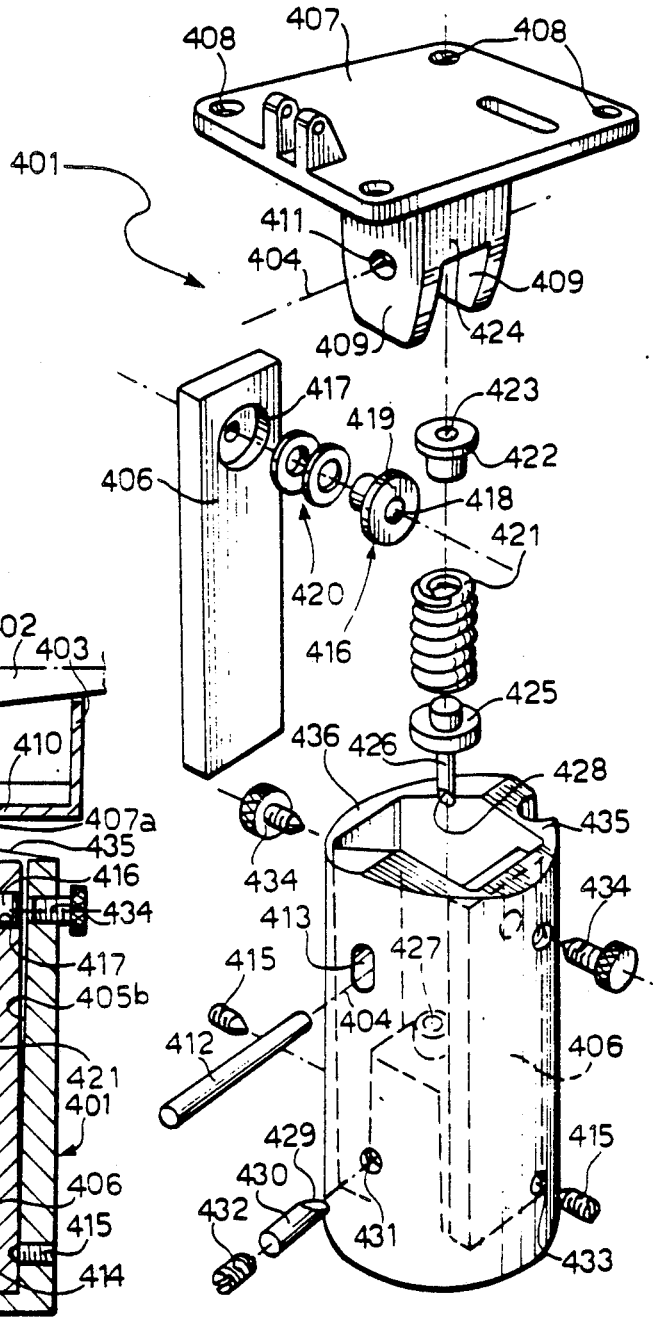
Figure 28:
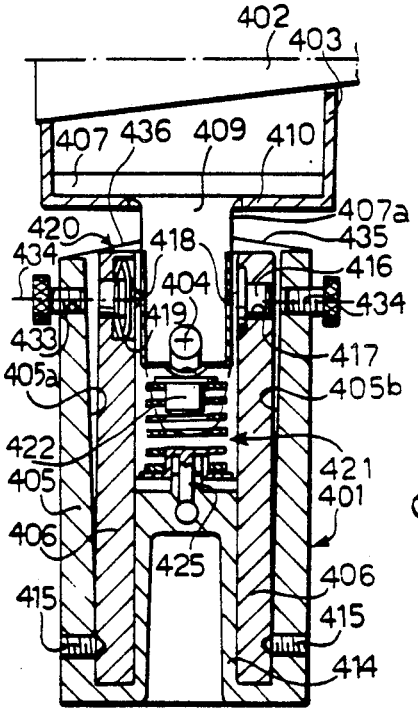
Figure 30:
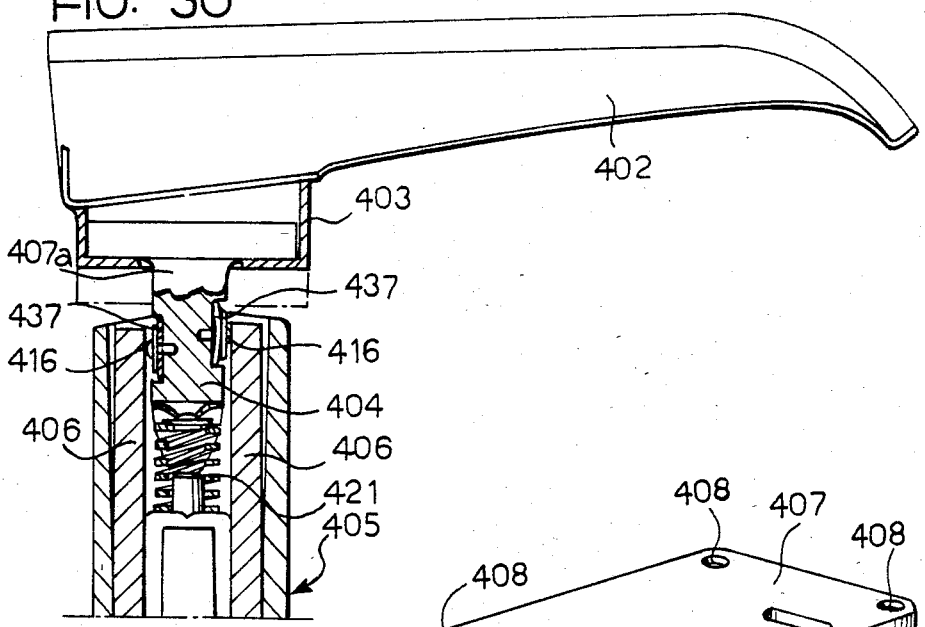
Figure 32:
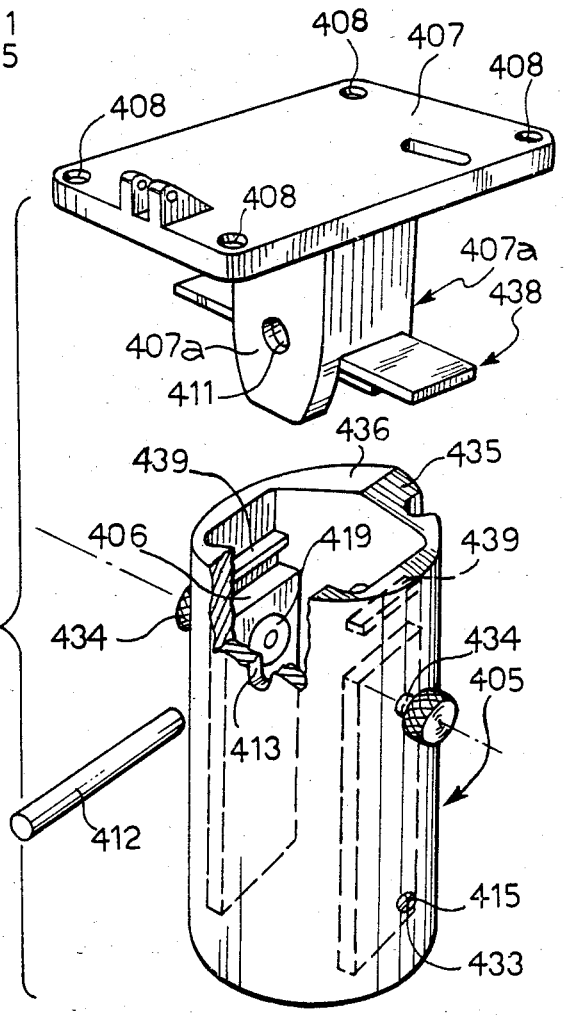
Figure 31:
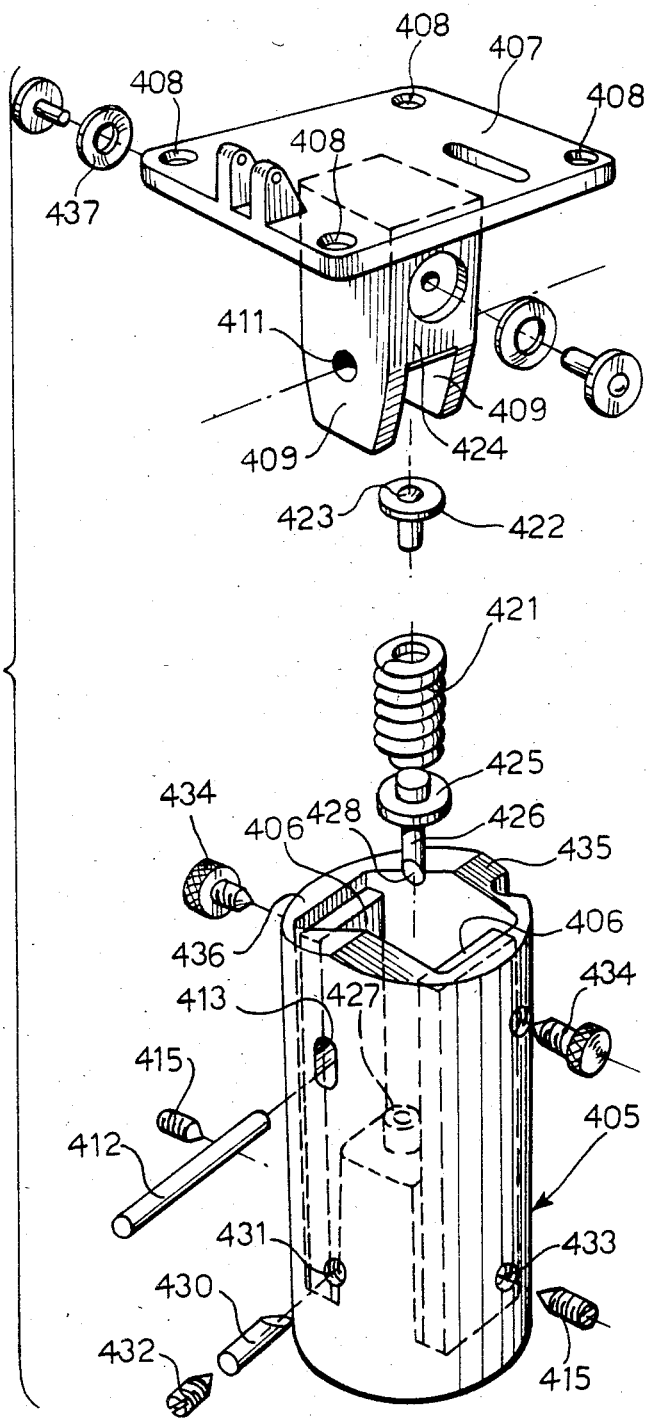

Further characteristics and advantages of the present invention will become apparent from the description which follows with reference to the appended drawings, provided purely by way of nonlimiting example, in which:

FIG. 1 is a schematic perspective view of a chair of the type to which the present invention is preferably applied, FIG. 2 is a view of a detail of FIG. 1 on an enlarged scale, FIG. 3 illustrates the detail of FIG. 2 in a different condition of operation, FIG. 4 is an exploded perspective view of a detail of a chair of the type illustrated in FIGS. 1 to 3 according to a first embodiment of the present invention, FIG. 5 is a perspective view of a detail of FIG. 4, FIG. 6 is a sectional view of a detail of the chair illustrated in FIGS. 4 and 5, FIG. 7 is a partially-sectioned exploded perspective view of the detail of FIG. 6, FIG. 8 is an exploded perspective view of a detail of the chair constituting the subject of a second embodiment of the invention, FIG. 9 is a perspective view of the detail of FIG. 8 illustrated in the assembled condition, FIG. 10 is a section taken on the line X—X of FIG. 9, FIG. 11 is a section taken on the line XI—XI of FIG. 10, FIG. 12 is a section taken on the line XII—XII of FIG. 11, FIG. 13 is a section taken on the line XIII—XIII of FIG. 12, FIG. 14 illustrates a variant of FIG. 13, FIGS. 15 and 16 are sections taken on the lines XV—XV and XVI—XVI of FIG. 14, FIG. 17 is a partial perspective view of a further variant, FIGS. 18 and 19 are two exploded perspective views of two details of the chair of FIG. 17, FIG. 20 illustrates a section of a detail of FIG. 17, FIGS. 21 to 23 are sections taken on the lines XXI, XXII and XXIII of FIG. 20, FIG. 24 is a sectional view of a detail of FIG. 19 on an enlarged scale, FIG. 25 is a partially-sectioned perspective view illustrating a portion of the chair according to a further variant, FIG. 26 is a sectional view taken on the line XXVI—XXVI of FIG. 25, FIG. 27 is an exploded perspective view of a detail of FIG. 26;

FIG. 28 is a sectional view of a detail of a further embodiment of the invention, the section corresponding to the vertical median plane through the chair, FIG. 29 is an exploded perspective view of the detail of FIG. 28, FIG. 30 illustrates a variant of FIG. 28, FIG. 31 is an exploded perspective view of the detail of FIG. 30, and FIG. 32 is an exploded perspective view illustrating a further variant of the detail of FIG. 28.

FIG. 1 illustrates schematically a chair of the type described in Italian Patent Application No. 67755-A/83 by the same Applicant and in the corresponding European Patent Application. One example of application of the present invention to this chair will be described below.

The chair, indicated 201 in FIG. 1, includes a backrest 203 and a seat 204 movable relative to a fixed base structure 202.

In the example illustrated schematically in FIG. 1, the fixed base structure 202 includes two pairs of side legs 205, each pair being constituted by a tubular element bent into a V shape and disposed with the vertex of the V facing upwardly. Clearly, however, this particular type of base structure is illustrated in the appended drawings solely by way of example. It could be replaced by any other type of base structure, such as a pedestal including a single central support column or the like.

As also illustrated in greater detail in FIGS. 2 and 3, the fixed structure 202 includes brackets 206 projecting forwardly from the ends of a cross member 207 which interconnects the two pairs of side legs 205. (In the case of a base structure constituted by a pedestal including a single central support column, the cross member 207 is connected centrally to the upper end of this support column).

In the present description and in the following claims the terms "forwardly" and "front" relate to the direction indicated by the arrow A in FIG. 1, that is, to the direction in which a person seated on the chair faces. The terms "rearwardly" and "back" relate to the opposite direction. Furthermore, the terms "transverse" and "transversely" relate to a direction perpendicular to the vertical plane of symmetry through the chair.

The backrest 203 is carried by a backrest support constituted by two support arms 208 which are substantially L-shaped and each of which is connected at its upper end to a respective side of the backrest 203. The lower end of each support arm 208 however, is articulated to the fixed structure 202 of the chair about a transverse axis 209.

The chair has travel limit means (which will be described in detail below) for limiting the rotation of the arms 208 about the articulation axis 209 so that the arms 208 can move between an extreme forwardly rotated position (illustrated in FIGS. 1 and 2) corresponding to a substantially erect condition of the backrest and an extreme rearwardly rotated position (illustrated in FIG. 3) corresponding to a partially reclined condition of the backrest.

Resilient biassing means (which will also be described in detail below) are also provided for biassing the support arms 208 of the backrest 203 into their extreme forwardly rotated position (see FIGS. 1 and 2).

The seat 204 is carried by a seat support constituted by two side support members 210 connected respectively to the two sides of the seat 204. The two support members 210 have their front ends articulated about a transverse axis 211 to the two front ends of the fixed support brackets 206. The articulation axis 211 is located adjacent the front edge of the seat 204.

The rear ends of the two side support members 210 are connected to the two L-shaped arms 208 fairly close to the corner of the L.

With reference to FIGS. 2 and 3, when the seated person presses his back against the backrest 203, the latter moves towards its rearwardly reclined position (see FIG. 3) against the action of the resilient biassing means which tend to keep it in the erect condition. As a result of the movement of the arms 208, the zone of connection of the support members 210 to the arms 208 moves downwardly causing a rearward inclination of the seat 204.

Clearly, from the above description and from the appended drawings, the articulation axis 209 between the backrest support and the fixed structure of the seat is offset forwardly relative to the rear edge of the seat, which allows the body of the seated person to adopt the correct posture when the seat is brought to the rest condition with the backrest rearwardly reclined. At the same time, the particular mechanism described and interconnecting the backrest support, the seat support and the fixed structure of the chair causes a rearward reclining of the seat, which prevents the body of the seated person slipping forwardly when the backrest is reclined rearwardly, the inclination of the seat however being less than the inclination of the backrest. Finally, since the seat 204 is articulated to the fixed structure of the chair substantially adjacent its front edge, this edge does not move upwardly to a noticeable extent when the seat is inclined rearwardly, which allows the maximum comfort to be achieved for the seated person.

FIGS. 4 to 7 illustrate a practical embodiment of the invention applied to a chair of the type illustrated in FIGS. 1 to 3. In a manner similar to that illustrated in the drawings, the chair of FIGS. 4 to 6 includes a fixed base structure including two pairs of side legs 1, 2 connected at their upper ends at each side of the chair by a support 15 and a cross member 3 fixed at each end to a respective support 15 by screws 16 engaged in holes 17 formed in the support 15 and in corresponding threaded holes (not visible in the drawing) formed in the end surface of the cross member. The backrest of the chair (not illustrated) is connected laterally to two support structures 4 (only one of which is visible in FIG. 4) which are substantially L-shaped and articulated to the fixed structure of the chair about a transverse horizontal axis 5 adjacent their front ends. More particularly, each backrest support 4 is articulated at its front end, with the interposition of a bush 18 clamped to the support 4 by means of a washer 19 and a screw 20, about a pin 21 projecting from the support 15, the axis of the pin 21 constituting the said horizontal transverse axis 5 for articulating the backrest to the fixed structure of the chair.

The seat (indicated 6 in FIG. 6) is articulated to the fixed structure of the chair in a manner similar to that illustrated in FIGS. 1 to 3. In particular, the lower side of the seat is connected on each side to a support 7 in the form of a box member articulated by a pin 22 to a further support 8, also of box form, about a transverse horizontal axis 9 located forwardly of the articulation axis 5 of the backrest. Each pair of supports 7, 8 defines a housing for a leaf spring 10 biassing the seat towards a raised position.

Each support 8 is articulated at its rear end 11 to a bracket 12 fixed to the cross member 3 by screws **12*a* engaged in threaded holes 12*b* in the cross member. The articulation is achieved by means of a pin 12*c* engaged in a hole 8*a* in the support 8 and two apertured lugs 12*d* of the bracket 12. The articulated connection of the supports 8 to the cross member 3 allows the seat of the chair to be tipped into a substantially vertical position. During movement of the seat between its operative position and the tipped, substantially vertical position, a lateral slot 13 in each support 7 moves relative to a pin 14 screwed into a threaded hole 4*a* in the respective backrest support 4**.

The backrest of the chair may be moved, as a result of a thrust exerted thereon by the seated person, from a first, substantially erect operative position to a second, partially-reclined operative position.

Each backrest support 4 has an associated resilient cartridge 23 biassing the respective backrest support 4 into the travel limit position corresponding to the substantially erect position of the backrest. This travel limit position is defined by the engagement of a pin 43 projecting from the outer side of the support 4 with the end of a slot **43*a* formed in the support 15. The leaf springs 10, however, tend to maintain the seat in a raised limit position relative to the support 4, which is defined by the engagement of the pin 14 with the lower end 14*a* of a vertical guide slot 14*c* formed in the inner side of the respective support 7 and opening into one end of the slot 13**.

The resilient cartridge 23 is constituted, in the embodiment illustrated, by two concentric helical springs 24, 25 interposed axially between two discs 26, 27. The discs 26, 27 and the springs 24, 25 are mounted around a shaft 28 which is in its turn slidable in a hole 29 in an end body 30 provided on its two opposite faces with pins 31, 32. The disc 27 is held in contact with the body 30 by the springs 24, 25, while the disc 26 is held by these springs in contact with an enlarged end portion 33 of the shaft 28. The end portion 33 has a transverse hole 34 for engagement by a pin 35 the ends of which are engageable with two apertured lugs 36 (only one of which is visible in FIG. 4) located on the lower part of the backrest support 4. The end 33 of the resilient cartridge 23 thus follows the movements of the backrest support 4, effecting a circular path about the articulation axis 5 of the backrest support.

The opposite end of the resilient cartridge 23 is connected to the fixed support 15 by a support lever 37. The support lever 37 is constituted by a plate having a pin 38 on one of its end faces, which is articulated in a hole 39 in the support 15 about an axis **39*a* and is retained axially within this hole by means of a screw 39*b* engaged in a central threaded hole in the pin 38. The support lever 37, on its end opposite that carrying the pin 38 and on its face opposite this pin, has a bush 40 for the articulated engagement of the pin 31 of the end body 30 of the resilient cartridge 23. The end 30 of the resilient cartridge can thus effect circular movements about the axis 39*a* of the pin 38, corresponding to a rotation of the support lever 37** about this axis.

The support lever 37 is maintained in a raised position by a helical spring 41 interposed between a pin **42*a* projecting from the outer face of the lever 37 and a pin 42*b* (see FIG. 5) carried by the support 15. The helical spring 41 is located in an aperture 44** formed in the support.

The end 30 of the resilient cartridge 23 is operatively connected to the respective seat support 7 by means of the transmission described below. The pin 32 is engaged in a slot 45 formed at the end of a lever 46 articulated about a horizontal transverse axis 47 to the respective backrest support 4. The lever 46 is articulated to the backrest support by means of a pin **47*a* engaged in a hole 48 in the backrest support (see also FIG. 6). The pin 47*a* also articulates a feeler member 49 having an upper surface 50 in contact with the lower surface of a tab 51 projecting from the inner side surface of the support 7. A helical spring, indicated 52, is interposed between the lower wall of the feeler member 49 and a tab 42*a* projecting from the lever 46**.

The transmission described above connects the ends 30 of the resilient cartridge 23 operatively to the seat support 7 so that (as will be described in more detail below), when the person sits on the seat causing the latter to lower against the action of the leaf-spring 10, the end 30 of the resilient cartridge 23 rotates downwardly about the axis **39*a* of the articulation pin 38 of the support lever 37**, disposing itself in a vertical position which depends on the weight of the seated person.

The end 30 of the resilient cartridge 23 is locked in this position when the backrest support 4 is inclined rearwardly as a result of a thrust exerted by the back of the seated person, by virtue of locking means including a latch member 53 and a stop member 54.

The latch member 53 is constituted by a plate mounted adjacent the support lever 37 and slidable longitudinally relative thereto. For this purpose, the plate 53 has two slots 55*a*, 55*b* engaged by two pins 56, 57 fixed in holes 58, 59 of the support lever 37. The slot 55*b* is longer than the slot 55*a* in that it must also house a helical spring 60 which is interposed between the pin 57 and the end 61 of the slot 55*b* opposite the pin. The helical spring 60 is retained laterally between the support lever 37 and a U-bracket 62 fixed to the face of the plate 53 located on the opposite side the lever 57. The lever 37 and the latch member 53 are located within a recessed portion 63 of the inner surface of the support 15. Within this recessed portion there is also fixed the stop member 54 which is constituted by an arcuate element carrying a plurality of freely-rotatable rollers 64 defining between them a series of seats for receiving selectively a tooth 65 projecting from the end of the latch member 53 which faces the stop member 54. A slot in the plate 53, indicated 66, allows the through passage of the bush 40.

To the outer face of the backrest support 4 is also fixed an auxiliary member 67 having a cam surface 68 for cooperating with a nib 69 disposed at the ends of the latch member 53 opposite the tooth 65.

The spring 60 normally biases the latch member 53 into an inoperative position in which the tooth 65 is spaced from the series of rollers 64. The support lever 37 is thus free to rotate about the axis of its articulation pin 38 relative to the fixed support 15 so as to allow the end 30 of the resilient cartridge 23 to locate itself in the position corresponding to the configuration taken up by the seat when a person is seated thereon.

When the seated person exerts a thrust with his back against the backrest, tending to move the latter into a rearwardly reclined position, the cam surface 68 engages the nib 69 so as to cause the latch member 53 to move into its operative position against the action of the spring 60. In this operative position, the tooth 65 engages in one of the spaces between the rollers 64 of the stop member 54 thus locking the end 30 of the resilient cartridge 23 in position.

The successive rearward rotation of the backrest causes the end 33 of the resilient cartridge to rotate about the articulation axis of the backrest support and the consequent loading of the springs 24,25. These latter are stressed from an initial load condition which is a function of the position of the end 30 of the resilient cartridge, which, as is seen, is in its turn a function of the weight of the seated person. The law of contraction of the springs 24, 25 as a function of the rotation of the backrest support 4 also depends on the position of the end 30 of the resilient cartridge 23.

When the seat is not occupied, the springs 10 maintain the seat in the raised travel limit position defined by the engagement of the pin 14 with the end 14*a* of the slot 14*c*. When a person sits on the seat, the end 14*a* of the slot 14*c* is moved downwardly relative to the pin 14. When the backrest is reclined, this movement occurs initially without a corresponding movement of the seat, as long as the pin 14 does not turn to engage the end 14*a* of the slot 14*c*. During this initial phase of movement of the backrest, the cam surface 68 causes the engagement of the tooth 65 in a corresponding seat of the stop member 54, locking the end 30 of the resilient cartridge 23 in the position taken up as a result of the first lowering of the seat. After the pin 14 has engaged the end 14*a* of the slot 14*c*, the reclining movement of the backrest is accompanied by a further lowering of the seat.

The operation of the mechanism described above is as follows:

When a person sits on the seat, the seat 3 is lowered, rotating about its articulation pins 22 and compressing the leaf springs 10. The seat obviously takes up a vertical position which is a function of the weight of the seated person. The downward movement of the seat causes a corresponding downward movement of the end 30 of each resilient cartridge 23 by means of the transmission constituted by the tab 51, the feeler member 49, the lever 46, and the pin 32.

When the seated person starts to exert a thrust against the backrest so as to tend to recline it rearwardly, the end 30 of each resilient cartridge 23 is locked in the position previously assumed by means of the action of each latch member 53 caused by the action of the cam surface 68 on the nib 69. In its operative condition, the latch member 53 has its tooth 65 engaged in one of the spaces between the rollers 64 of the stop member 54 fixed to the support 15. The further movement of the backrest is opposed by the resilient cartridges 23 which react to this movement starting from a loaded condition which is a function of the vertical position of the end 30 of each resilient cartridge, that is, is a function of the weight of the seated person. Again, the law of contraction of the resilient cartridges as a function of the rotation of the backrest is, as already stated, dependent on the weight of the seated person.

FIGS. 8 to 13 illustrate a variant of the chair described above.

This variant differs from that illustrated in FIGS. 4 to 7 mainly with regard to the structure and conformation of the transmission connecting the seat to the end 30 of each resilient cartridge 23, and the conformation of the locking means for locking the end 30 of each resilient cartridge in the position taken up as a result of the lowering of the seat when the backrest is reclined rearwardly. The parts in common with the preceding drawings are indicated by the same reference numerals.

In the embodiment illustrated in FIGS. 8 to 13, the seat of the chair is of the type which cannot be tipped fully into a substantially vertical position, in which each support 8 is connected rigidly and formed in a single piece with the cross member 3. A further difference with respect to the example described previously lies in the fact that the resilient means for opposing the lowering of the seat are constituted by a pair of helical springs 70 each interposed between the end of the cross member and the lower surface of the support 7.

The support lever 37 of the end 30 of each resilient cartridge 23 is rotatably mounted on the support 15 by means of the engagement of a pin 38*a* projecting from the support 15 in a hole 37*a* in the lever 37. In this case also, the end 33 of the resilient cartridge is articulated to the backrest support 4 by means of a pin 35 engaged in a hole 34 in the end 33 and a threaded hole 4*a* in the backrest support 4. The pin 14 is formed in a single piece with the pin 35 as an elongation thereof. The transmission connecting the end 30 of each resilient cartridge 23 operatively to the seat comprises a lever 71 having one end with a slot 72 engaged by the pin 14 (see also FIG. 12). The opposite end 73 of the lever 71 is articulated to the end body 30 of the resilient cartridge 23. The lever 71 is also connected to the respective support 7 (provided with a guide slot 7a for the pin 14) by means of a shaft 74 having an upper end 75 connected by a pin 75a to the support 7. The lever 71 is connected to an element 76 within which the shaft 74 is slidable. Two return springs 77, 78 are mounted on the shaft and are interposed respectively between the end 75 and the element 76 and between the element 76 and a washer 79 fixed to the shaft by a pin 80.

When the seat is lowered, compressing the springs 70 as a result of the weight of the seated person, the shaft 74 transmits this lowering to the lever 71 by means of the springs 77,78 and the element 76, thus causing a corresponding lowering of the end 30 of the resilient cartridge 23. This latter is lowered, effecting a rotation of the support lever 37 about its articulation pin 38a until it takes up a position which is a function of the weight of the seated person.

The support lever 37 is connected operatively to a slide member 81 having a pin 82 engaged in a slot 83 in the lever 37. The slide element 81 is slidable vertically in a groove 83a formed in an element 84 fixed to the inner face 85 of the support 15. A pin 86 projects from the support 15 and is engaged in a slot 86a formed in the outer side of the respective backrest support 4 so as to act as a travel limit stop for the latter. The slide element 81 has a recess 87 which avoids interference with the pin 86. Reference numeral 88 indicates a roller acting as a latch member located between a side surface of the slide element 81 and on inclined surface 89 facing the said side surface of the slide element 81 (see FIG. 13) and forming part of a stop member 90 fixed to the support 15. The roller 88 is thrust upwardly by a helical spring 91 having its upper end in contact with the roller 88 and its lower end housed in a seat in the stop member 90. The spring 91 biases the roller 88 upwardly, so as to wedge it between the surface 89 and the side surface of the slide element 81, consequently locking the slide element 81 relative to the support 15.

A rocker arm, indicated 92, is articulated at 93 (see FIG. 13) to the support 15 and having one end in contact with the roller 88 and its opposite end, which in the erect condition of the backrest is in contact with the pin 94 (see FIG. 8), projecting from the outer surface of the backrest support 4.

The operation of the mechanism described above is as follows:

When the backrest is in its erect condition, the pin 94 urges the corresponding end of the rocker arm 92 upwardly whereby the opposite end of this arm presses the roller 88 downwardly against the action of the spring 91. Thus, the roller 88 is kept spaced from its wedged position between the slide element 81 and the stop member 90. The slide element 81 is thus free to move vertically within the groove 83.

When the seat 6 is lowered as a result of the weight of the seated person, the transmission constituted by the shaft 74, the springs 77, 78, the element 76, and the lever 71 causes a corresponding lowering of the end 30 of the resilient cartridge 23. This end 30 moves downwardly effecting a rotation about the axis 39a of the pin 38a, the rotation being accompanied by a corresponding rotation of the support lever 37. This latter, moving downwardly, entrains the slide element 81 therewith, which, as already explained above, is free to move in this phase within the groove 83. In conclusion, the element 81 disposes itself in a vertical sense in a position which is a function of the weight of the seated person, the same being true for the end 30 of the resilient cartridge 23.

When the seated person starts to exert a thrust against the backrest with his back, tending to move it to a partially reclined condition, the pin 94 moves away from the rocker arm 92 whereby the roller 88 is free to move upwardly, thrust by the spring 91, causing the slide element 81 to become locked relative to the support 15. The locking of the slide element also causes the locking of the end 30 of the resilient cartridge 23. The subsequent rearward rotation of the backrest compresses the resilient cartridge 23 from an initial load condition which is a function of the position of the end 30 of the cartridge, that is, of the weight of the seated person. Again, the law of contraction of the resilient cartridge 23 as a function of the rotation of the backrest depends on the position of the end 30 of the resilient cartridge, that is, on the weight of the seated person. As in the case of FIGS. 4 to 7, the first rotation of the backrest occurs without a corresponding movement of the seat, whereby the position of the end 30 is not altered as long as it is not locked by means of the mechanism described above. When the pin 14 comes into contact with the lower end of the slot 7a it causes, with a further rotation of the backrest, a corresponding rotation of the seat.

FIGS. 14 to 16 illustrate a variant of the mechanism of FIG. 8 which differs from the latter solely in a different conformation of the locking means for the end 30 of the cartridge. In this case the support lever 37, which is articulated to the support 15 by means of an articulation pin 95, has a recessed surface 96 in its surface facing the support 15 and defined at one end by an arcuate concave surface 97 the axis of which coincides with the axis of the pin 95. The latch member is constituted by a sector element 98 articulated to the support 15 by means of an articulation pin 99 having a position intermediate that of the pin 95 and the opposite end of the lever 37. The sector element 98 has a convex arcuate surface 100 the center of which lies on the axis of the pin 99 facing the concave arcuate surface 97 of the support lever 37. Between the sector element 98 and a bearing surface 15b of the support 15 is a helical spring 101 which biases the sector element 98 into a raised position, in which it locks the support lever 37 in position as a result of the mutual engagement of the two surfaces 100, 97 which have different curvatures from each other. When the backrest is in its erect position, the sector element 98 is thrust downwardly, against the action of the spring 101, by means of the rocker arm 90 which has one end acting on the sector element 98 and its opposite end thrust upwardly by the pin 94 in the backrest support 4. When this backrest support is reclined rearwardly, the pin 94 is lowered, leaving the sector element 98 free to move upwardly under the action of the spring 101 to lock the support lever 37. For the rest, the operation of the mechanism is exactly the same as that described with reference to FIGS. 8 to 13.

Naturally, other variants which are different from those described above may be made.

For example, in the embodiment illustrated in FIG. 8, the slide element 81 which is slidable vertically relative to the support 15 could be replaced by a circular sector element articulated to the support 15 and having a convex arcuate surface in contact with the roller 88 and opposing the inclined surface 89.

However, in the case of the embodiment illustrated in FIGS. 4 to 7, the series of rollers 64 carried by the stop member 54 and the tooth 65 carried by the latch member 53 could be replaced by two opposing arcuate elements have friction covers or rubber covers. It is also possible to use an element having a series of seats arranged to cooperate with the tooth 65 instead of the rollers 64.

Furthermore, the resilient return means for the seat illustrated in FIG. 4 could be constituted, instead of by the leaf spring 10, by a helical spring of the type shown at 70 in FIG. 8 or vice versa.

In the embodiment illustrated in FIGS. 4 to 7, the seat of the chair is fully tippable into a substantially vertical position. Clearly, this seat need not be tippable as in the embodiment of FIGS. 8 to 13. Similarly, the seat illustrated in the latter drawings could be tippable in a manner similar to that illustrated in FIGS. 4 to 7.

The embodiment which is illustrated in FIGS. 17 to 24 of the appended drawings also relates to an application of the invention to a chair of the type illustrated in FIGS. 1 to 3. In particular, this chair includes a backrest 250 which is partially rearwardly reclinable and a seat 251 which is also rearwardly reclinable and arranged to follow the reclining movement of the backrest with a pivoting movement of an amplitude less than that of the backrest.

In more detail, the fixed base structure of the chair comprises two pairs of side legs 252 connected at their upper ends by a cross member 253. The backrest 250 has a support structure including two side arms 254 which are substantially L-shaped and have their front ends articulated to the fixed structure of the chair about a first transverse horizontal axis 255 spaced forwardly of the rear edge of the seat. This latter has two side supports 256 below it which are articulated to the fixed structure of the chair about a second transverse horizontal axis 257 adjacent the front edge of the seat and located forwardly of the first transverse horizontal axis 255. The articulated mounting of the seat about the axis 255 is achieved by means of two fixed arms 258 projecting forwardly from the ends of the transverse member 253.

In this embodiment, the resilient means for returning the seat to the raised position are shaped and disposed so that they also effect a substantial part of the action for opposing the rearward reclining movement of the backrest These resilient return means for the seat comprise a series of helical springs interposed between the bottom of the cross member 253 (which has a substantially channel-shaped cross-section) and an auxiliary cross member 260 in the form of an inverted channel which is vertically displaceable within the cross member 253.

With reference to FIGS. 17, 19 and 24, two pairs of helical springs are provided in correspondence with each end of the cross member, each pair being constituted by two helical springs 261, 262 which are concentric and interposed between a lower disc 263 fixed to the bottom of the cross member 253 and an upper disc 264 fixed to the auxiliary member 260. The position of maximum elongation of the springs 261, 262 is defined by a cup member 265 mounted within a hole 266 in the disc 264 and having a hole 267 in its bottom (see FIG. 24) in which a vertical pin 268 is slidable, the lower end of the pin being connected to the cross member 253 and to the disc 263 by means of resilient rings 269 and its upper end having a head with a larger diameter than the hole 267.

As illustrated in FIG. 17 and 19, the two lateral supports 256 for the seat have holes 270 for screws 271 (see FIG. 19) for fixing the seat, and holes 259 for the disc 264 for bearing the four pairs of helical springs 261, 262.

Each lateral support 256 has a pin 256*a* (see FIG. 17) at its front end for articulation to the arm 258, and a pin 274 at its rear end projecting laterally outwardly and intended to act as a stop member connectible operatively to the respective arm 254 for supporting the backrest, as will be explained in more detail below.

With reference to FIGS. 18 to 23, each pair of side legs 252 is connected at its upper end by a connector part 275 having holes 276 for screws 277 for fixing it to the corresponding substantially dish-shaped end part 253*a* of the cross member 253.

The connector part 275 has a projecting pin 278 on its inner side for the articulation of the arm 254 for supporting the backrest about the horizontal transverse axis 255. The arm 254 has a hole 279 at its front end for receiving the pin 278 with the interposition of a bush 280.

The arm 254 also has a slot 281 engaged by a pin 281*a* projecting from the inner side of the connection part 275. The function of the pin 281*a* and the slot 281 is to limit the angular pivoting of the arm 254, as will be explained below.

The horizontal limb of each arm 254 has a flat-bottomed depression 282 on each of its opposing vertical faces, into which the hole 279 and the slot 281 open. A respective auxiliary plate 283, 284 is located in each depression. The two plates 283, 284 each have a hole 285 for their articulated assembly on the bush 280 (see FIG. 22), this articulation being clamped by a disc 286 screwed onto the end surface of the pin 278. The two plates 283, 284 are also connected together by a spacer element 287 (see FIGS. 18, and 23) fixed thereto by a screw 288. The plates 283, 284 also each have a slot 289 in which the pin 281*a* engages. A pair of concentric helical springs 290, 291 is mounted on a shaft 292 which has an end 293 articulated to a pin 294 having its ends mounted in two holes 295 in the plates 283, 284. The opposite end of the shaft 292 is connected to a transverse pin 296 which is articulated in a transverse hole 297 in the connector part 275. Two bearing discs, indicated 298, are interposed between the springs 290 and 291, and the transverse pin 296 and the end 293, respectively.

The plate 283 has an aperture 299 in which the transverse pin 274 carried by the side support of the seat 256 is supported. Furthermore the pin 294 has a part projecting inwardly of the chair relative to the plate 283 on which is articulated a lever 300 for cooperating with the pin 274. Finally, the arm 254 for supporting the backrest has a pin 301 projecting from its surface facing inwardly of the chair, the pin having a roller 302 for cooperating with the lever 300.

The operation of the device described above is as follows:

For simplicity, it is assumed that initially the seated person does not exert a thrust on the backrest 250 in order to recline it rearwardly. Under these conditions, the weight of the seated person bears on the seat 251 causing a rearward reclination of the latter about the articulation axis 257 and the consequent loading of the four pairs of helical springs 261, 262. The corresponding lowering of the pins 274 carried by the lateral supports 256 for the seat occurs freely within the apertures 299 of the two corresponding plates 283, without this movement causing a corresponding movement of the backrest.

In this phase, therefore, the helical springs 261, 262 act as resilient means for detecting the weight of the seated person and the seat disposes itself in a position which is a function of this weight.

When the seated person starts to push the backrest towards its reclined position, the pin 301, rotating about the articulation axis 255, pushes the lever 300 into contact with the pin 274 (which in the meantime has been lowered from the position illustrated in FIG. 20) so as to connect the pin operatively to the auxiliary plate 283 of the support arm of the backrest 254.

From this moment on, the rearward reclining movement of the backrest continuing, the helical springs 261, 262 become loaded (and in this phase exert a substantial part of their reaction force against the reclining of the backrest), this loading occurring from the loaded condition caused by the weight of the seated person.

Since the action of returning the backrest to the non-reclined position is due mainly to the springs 261, 262, this return action is varied automatically and considerably in dependence on the weight of the seated person. Indeed, as described above, when the backrest starts to be reclined rearwardly, the resilient return means 261, 262 are loaded from a loaded condition dependant on the weight of the seated person.

FIGS. 25 to 27 illustrate a variant of the chair according to the invention which operates in a similar manner to that explained with reference to FIGS. 17 to 24.

In particular, the chair of FIGS. 25 to 27 also includes actuator means (not illustrated in these drawings) identical to those illustrated in FIGS. 17 to 24 for connecting the seat operatively with the backrest (so as to cause a rearward reclining of the seat as a result of a rearward reclining of the backrest) only when the seated person starts to exert a force against the backrest and to allow the movement of the seat independently of the backrest as long as the seated person does not exert a force against the backrest.

The chair of FIGS. 25 to 27 differs from that of FIGS. 17 to 24 solely in that the resilient means for returning the seat towards the raised position are constituted by leaf springs similar to the case of FIGS. 4 to 7. The constructional details and the disposition of the lateral supports for the seat are again identical to those of FIGS. 4 to 7. For this reason, the various parts of the chair of FIGS. 25 to 27 have been indicated by the same reference numerals as used in FIGS. 4 to 7. When the seated person exerts a force on the backrest, the latter is returned to the erect position by the leaf springs 10 acting directly on the seat. These springs thus act at the same time as means for sensing the weight of the seated person and resilient means for returning the seat and the backrest to the erect position. Furthermore, when the backrest is reclined rearwardly, the leaf springs 10 tend to oppose this movement from a loaded condition which is a function of the position taken up by the seat, that is, a function of the weight of the seated person.

In FIGS. 25 to 27, the structure and conformation of the actuator means which connect the backrest operatively to the seat are not illustrated in that they are entirely identical to those described with reference to FIGS. 17 to 24. Furthermore, the elimination of these details from FIGS. 25 to 27 renders the drawings simpler and easier to understand.

FIGS. 28 to 32 of the appended drawings relate to a further embodiment of the chair according to the invention.

This further embodiment relates to the case in which the chair has a seat 402 pivotally mounted on the support structure of the chair about a transverse horizontal axis 404, this support structure including a vertical base column on the top of which is mounted the device illustrated in the drawings.

In the embodiment illustrated, the seat is movable from a normal operative position to both a rearwardly reclined position (to allow a relaxed posture) and to a forwardly inclined position (to allow a more correct posture for activities such as typing or data processing). Clearly, however, the invention is also applicable to the case in which the seat is able to effect only one of these two movements.

The device illustrated, generally indicated 401, includes a hollow body 405 fixed to the top of the base column of the chair not illustrated), within which are disposed two resilient blades 406 each lying in a vertical plane parallel to the pivot axis 404 of the seat 402.

As is seen in FIG. 28, the seat 402 has a cross member 403 underneath it which has a channel section. Within a central zone of the cross member 403 is a plate 407. The plate 407 has holes 408 for screwing it to the bottom of the cross member 403 and below it has a tang **407*a* including two flat parallel walls 409 projecting beneath the cross member 403 through an aperture 410 in this member. The two flat walls 409 have two aligned holes 411 for the articulation of the tang 407*a* on a pin 412. This pin 412 has ends projecting outwardly of the two flat walls 409, which are slidably housed in two vertical slots 413 formed in diametrically opposite zones of the wall of the hollow body 405 (see FIG. 29**).

Each resilient blade 406 is fixed at its lower end in a seat 414 in the body 405 by means of a locking pin 415. Furthermore, the inner surface of the hollow body 405 has two portions **405*a*, 405*b* facing the two resilient blades 406** and diverging upwardly so as to allow the resilient blades to bend, as will be explained in greater detail below.

The two resilient blades 406 are in contact on opposite sides with the vertical edges of the two lugs 409 adjacent their upper ends. There is substantially point contact between each resilient blade 406 and the tang **407*a* of the plate 407, since each resilient blade has a stop member 416 mounted in a corresponding seat 417 and having a hemispherical head 418 and a collar 419. In the case of the resilient blade 406 which is located rearwardly of the tang 407*a*, auxiliary resilient means 420 constituted by a pair of cup springs are interposed between the bottom of the seat 417 and the collar 419** of the stop member.

Between the tang **407*a* and the bottom of the body 405 are resilient means 421 which, in the example illustrated, are constituted by a helical spring. These resilient means oppose a lowering movement of the seat caused by the weight of the seated person. In more detail, the upper end of the helical spring 421 has a stop member 422 with a hemispherical head 423 in contact with a wall 424 rigid with the tang 407*a*. The lower end of the spring 421, however, bears on a support disc 425 having a vertical pin 426 beneath it, which is slidable in a vertical hole 427 (see FIG. 29) formed in the bottom of the hollow body 405. The lower end of the pin 426 has an inclined surface 428 cooperating with a corresponding inclined surface 429 of a pin 430 which is slidable in a horizontal hole 431 formed in the side wall of the body 405. The position of the pin 430 in the hole 431 can be changed by means of the threaded pin 432** which is screwed into a threaded end portion of the hole 431. Thus, it is possible to change the vertical position of the pin 426 so as to adjust the consequent loading of the spring 421, by virtue of the mutual engagement of the inclined surfaces 429, 428 and the two pins 430, 426.

The side wall of the hollow body 405 has, in correspondence with the facing zones at the upper ends of the two resilient blades 406, two threaded holes 433 into which two screws 434 are screwed, the function of which will be explained below. Finally, the upper end surface of the body 405 has a roof configuration defined by two inclined surface portions 435, 436 the function of which will also be explained below.

The function of the device described above is as follows:

When a person sits on the chair, the seat yields vertically as a result of the weight bearing thereon, the lowering movement being opposed by the helical spring 421. Thus, the position of the seat in a vertical sense and consequently of the articulation pin 412 relative to the base column of the seat is a function of the weight of the seated person.

When the seated person exerts a thrust on the seat with his body so as to tend to pivot the seat about the axis 404 towards a forwardly or rearwardly reclined position, the tang 407*a* acts as a thrust member and bends the corresponding resilient blade 406.

The bending moment exerted on the resilient blade is a function of the weight of the seated person in that, for different weights, the height of the pivot axis 404 differs and hence the distance of this axis from the straight line normal to the point of contact between the resilient blade and the member 407*a* differs.

The action of returning the seat towards the non-reclined position is thus adjusted automatically in dependence on the weight of the seated person so as to ensure an identical level of comfort for persons of different weights.

The inclined portions 405*a*, 405*b* of the inner surface of the hollow body 405 are provided in order to leave the space necessary for the bending of the resilient blade 406 free, the surface 405*a* having an inclination greater than the surface 405*b* in that the amplitude of rearward pivoting required is usually greater than that for forward pivoting. The position of maximum bending of the resilient blades 406 may be adjusted, however, by means of the screws 434. The inclined surfaces 435, 436 at the upper end of the body 405, which act as travel limit stops for the cross member 403, also have different inclinations for the same reason. The auxiliary resilient means 420 are provided in order to avoid the risk of the resilient blade 406 disposed rearwardly exceeding its elastic limit as a result of the relatively high deformations to which it is subjected. As already explained above, the load of the helical spring 421 may however be adjusted by means of the screw 432.

The variant illustrated in FIGS. 31 and 31 differs from the solution of FIGS. 28 and 29 only in that the two stop members 416 are carried by the tang 407*a* instead of by the two resilient blades 406. Moreover, a cup spring 437 is interposed between each stop member 416 and the tang 407*a* in order to avoid the risk of excessive forces on the resilient blades 406. In order to prevent the elastic limit of the blade 406 disposed rearwardly being exceeded , the stop member 416 cooperating therewith is in a position closer to the axis 404 than the other stop member.

The operation of the device of FIGS. 30 and 31 is identical to that already illustrated, with the difference that in this case the distance between the pivot axis 404 and the straight line normal to the point of contact between each resilient blade and the respective stop member 416 remains constant, while the height of this point of contact with respect to the blade varies. As a result, the bending moment to which each blade is subject is again a function of the height of the seat and hence of the weight of the seated person.

The variant of FIG. 32 differs from the device of FIGS. 28 and 29 solely in that the resilient means opposing the lowering of the seat caused by the weight of the seated person are constituted, instead of by a helical spring, by a leaf spring 438 comprising a single leaf located in a horizontal plane connected centrally to the member 407*a* and having its ends housed in two seats 439 formed within the hollow body 405.

The operation is identical to that already described for the solution of FIGS. 28 and 29.

Naturally, the principle of the invention remaining the same, the constructional details and forms of embodiments may be varied widely with respect to that described and illustrated purely by way of example, without thereby departing from the scope of the present invention.

I claim:

1. A chair comprising:

a fixed base structure, a seat support structure having a seat secured thereto, a backrest support structure having a backrest secured thereto, said backrest support structure being articulated to said fixed base structure about a horizontal transverse axis and moveable from a first operative position, corresponding to a substantially erect condition of the backrest, to a second operative position, corresponding to a partially-reclined condition of the backrest, as a result of a thrust exerted by the body of a seated person, first resilient means operatively connected between said backrest support structure and said fixed base structure for biasing said backrest support structure towards its first operative position, said seat support structure being articulated to said fixed base structure and having at least one portion which is moveable substantially vertically and independently from said backrest support structure from a raised position to a lowered position as a result of the load exerted by the body of a seated person, second resilient means operatively connected between said moveable part of said seat support structure and said fixed structure for biasing said moveable part of said seat support structure towards its raised position so that when a person is seated upon said seat, the latter reaches a position which is dependent upon the weight of the seated person, and means operatively connected between said moveable part of said seat support structure and said first resilient means for adjusting the load of said first resilient means, said adjusting means being responsive to the position reached by the seat immediately after a person sits thereon so that the load of the first resilient means is adjusted as a function of the weight of a seated person.

2. A chair as set forth in claim 1 wherein said seat support structure is articulated to said fixed base structure about a second horizontal transverse axis located forwardly of said axis of articulation of said backrest support structure, said seat support structure being operatively connected to said backrest support structure so as to recline rearwardly following the reclining movement of said backrest starting from the position reached immediately after a person sits on said seat.

3. Chair according to claim 2, wherein the said resilient biassing means comprise at least one resilient cartridge having a first end connected to the support structure of the backrest at a point spaced from the axis of articulation of the support structure of the backrest to the fixed structure of the chair, whereby the first end of the resilient cartridge effects a circular path about the said articulation axis when the backrest is reclined, and a second end supported by the fixed structure by means of a lever articulated to the fixed structure about an axis parallel to and spaced from the articulation axis of the backrest support structure, the second end being connected operatively to the seat, and wherein the automatic adjusting means include means for locking the second end of the resilient cartridge in the position adopted as a result of the lowering of the seat caused by the weight of the seated person when the backrest is reclined.

4. Chair according to claim 3, wherein the said locking means include a latch member movable relative to the support member of the second end of the resilient cartridge, a stop member carried by the fixed structure having a plurality of seats for cooperating with the latch member to lock the second end of the resilient cartridge in position, resilient means biassing the latch member into an inoperative position, and cam means carried by the support structure of the backrest to cause the engagement of the latch member in one of the seats of the stop member when the backrest is reclined.

5. Chair according to claim 4, wherein the said latch member has a tooth for cooperating with a plurality of freely rotatable rollers carried by the stop member and defining the said seats between them.

6. Chair according to claim 3, wherein the locking means include:

a latch member movable relative to the support lever of the second end of the resilient cartridge;

a stop member carried by the fixed structure of the chair;

auxiliary resilient means biassing the latch member into engagement with the stop member so as to lock the support lever for the second end of the resilient cartridge, and a lever transmission for maintaining the latch member in its inoperative position against the action of the auxiliary resilient means when the backrest is in its substantially erect position.

7. Chair according to claim 6, wherein the said latch member is constituted by a roller interposed between two opposing mutually-inclined wedge surfaces belonging to the stop member and to a slide member respectively, the slide member being connected operatively to the support lever for the second end of the resilient cartridge.

8. Chair according to claim 6, wherein the said latch member is constituted by a circular sector member articulated to the fixed structure about an axis parallel to and spaced from the axis of articulation of the support lever for the second end of the resilient cartridge, the circular sector member and the support lever having facing arcuate surfaces with different curvatures and the auxiliary resilient means biassing the circular sector member into a condition corresponding to mutual engagement of the said facing arcuate surfaces.

9. Chair according to claim 2, wherein the said automatic adjusting means comprise actuator means for connecting the seat operatively with the backrest only when the seated person starts to exert a thrust against the backrest and for allowing the movement of the seat independently of the backrest as long as the seated person does not exert the said thrust against the backrest, the said resilient return means for the seat being shaped and disposed so as to also act as resilient biassing means for the backrest.

10. Chair according to claim 9, wherein the said actuator means comprise at least one stop member carried by the seat, and means for connecting the stop member operatively to the support structure of the backrest when the latter is reclined.

11. Chair according to claim 10, wherein the said support structure of the backrest has an associated auxiliary member also rotatably mounted about the said first transverse horizontal axis and having a seat in which the said stop member is movable, and wherein the said means for connecting the stop member operatively to the support structure of the backrest comprise a retaining lever which is articulated on the said auxiliary member, and an actuator member carried by the support structure of the backrest and arranged to engage the retaining lever so as to cause this retaining lever to engage the stop member and consequently lock the latter within the said seat of the auxiliary member when the backrest is reclined.

12. Chair according to claim 11, wherein at least one helical spring is interposed between a zone of the auxiliary member spaced from the first transverse horizontal axis and a zone of the fixed structure which does not coincide with this axis.

13. Chair according to claim 12, wherein the said resilient return means for the seat include at least one helical spring interposed between the fixed structure and the seat.

14. Chair according to claim 13, wherein the said resilient return means for the seat include at least one pair of helical springs interposed between the seat and the fixed structure of the chair adjacent the sides of the seat.

15. Chair according to claim 14, wherein the said fixed structure of the chair includes a transverse member and wherein each helical spring is interposed between the transverse member and the seat.

16. Chair according to claim 12, wherein the said resilient return means for the seat include at least one leaf spring interposed between the fixed structure and the seat.

17. Chair according to claim 16, wherein the said resilient return means comprise a pair of leaf springs interposed between the seat and the fixed structure of the chair adjacent the sides of the seat.

18. Chair according to claim 17, wherein the said fixed structure of the chair includes a transverse member and each of the two said leaf springs is housed in a casing formed by two box-shaped supports connected to the seat and to the transverse member, respectively.

* * * * *